US008863835B2

(12) United States Patent
Schultz et al.

(10) Patent No.: US 8,863,835 B2
(45) Date of Patent: Oct. 21, 2014

(54) VARIABLE FREQUENCY FLUID OSCILLATORS FOR USE WITH A SUBTERRANEAN WELL

(75) Inventors: Roger L. Schultz, Ninnekah, OK (US); Robert Pipkin, Marlow, OK (US); Tim Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 653 days.

(21) Appl. No.: 13/215,572

(22) Filed: Aug. 23, 2011

(65) Prior Publication Data

US 2013/0048274 A1 Feb. 28, 2013

(51) Int. Cl.

| | |
|---|---|
| ***E21B 34/08*** | (2006.01) |
| ***E21B 28/00*** | (2006.01) |
| ***E21B 43/00*** | (2006.01) |
| ***E21B 47/18*** | (2012.01) |

(52) U.S. Cl.

CPC ..... *E21B 28/00* (2013.01); *E21B 43/003* (2013.01); *E21B 47/18* (2013.01)

USPC ..... 166/244.1; 166/386

(58) Field of Classification Search

USPC ..... 137/835, 836, 838, 840, 841; 166/386, 166/244.1

See application file for complete search history.

(56) References Cited

U.S. PATENT DOCUMENTS

| | | | | |
|---|---|---|---|---|
| 2,324,819 | A | | 6/1941 | Butzbach |
| 3,091,393 | A | | 5/1963 | Sparrow |
| 3,114,390 | A | * | 12/1963 | Glattli ..... 137/817 |
| 3,461,897 | A | | 8/1969 | Kwok |
| 4,276,943 | A | | 7/1981 | Holmes |
| 4,385,875 | A | | 5/1983 | Kanazawa |
| 4,418,721 | A | | 12/1983 | Holmes |
| 4,919,204 | A | | 4/1990 | Baker et al. |
| 5,135,051 | A | | 8/1992 | Facteau et al. |
| 5,165,438 | A | | 11/1992 | Facteau et al. |
| 5,184,678 | A | | 2/1993 | Pechkov et al. |
| 5,455,804 | A | | 10/1995 | Holmes et al. |
| 5,484,016 | A | | 1/1996 | Surjaatmadja et al. |
| 5,533,571 | A | | 7/1996 | Surjaatmadja et al. |

(Continued)

FOREIGN PATENT DOCUMENTS

| | | | |
|---|---|---|---|
| EP | 0834342 | A2 | 4/1998 |
| EP | 1857633 | A2 | 11/2007 |

(Continued)

OTHER PUBLICATIONS

Office Action issued Oct. 23, 2013 for U.S. Appl. No. 12/983,144, 38 pages.

(Continued)

*Primary Examiner* — David Bagnell
*Assistant Examiner* — Ronald Runyan
(74) *Attorney, Agent, or Firm* — Smith IP Services, P.C.

(57) ABSTRACT

A well tool can include a first oscillator which varies a flow rate of fluid, and a second oscillator which discharges the fluid received from the first oscillator at a variable frequency. A method can include flowing a fluid through a first oscillator, thereby repeatedly varying a flow rate of fluid discharged from the first oscillator, and receiving the fluid from the first oscillator into a second oscillator. A well tool can include a first oscillator including a vortex chamber, and a second oscillator which receives fluid flowed through the vortex chamber.

15 Claims, 22 Drawing Sheets

(56) References Cited

U.S. PATENT DOCUMENTS

| | | | |
|---|---|---|---|
| 5,893,383 | A | 4/1999 | Facteau |
| 6,009,951 | A | 1/2000 | Coronado et al. |
| 6,015,011 | A | 1/2000 | Hunter |
| 6,233,746 | B1 | 5/2001 | Skinner |
| 6,241,019 | B1 | 6/2001 | Davidson et al. |
| 6,336,502 | B1 | 1/2002 | Surjaatmadja et al. |
| 6,345,963 | B1 | 2/2002 | Thomin et al. |
| 6,367,547 | B1 | 4/2002 | Towers et al. |
| 6,371,210 | B1 | 4/2002 | Bode et al. |
| 6,405,797 | B2 | 6/2002 | Davidson et al. |
| 6,497,252 | B1 | 12/2002 | Kohler et al. |
| 6,619,394 | B2 | 9/2003 | Soliman et al. |
| 6,622,794 | B2 | 9/2003 | Zisk, Jr. |
| 6,627,081 | B1 | 9/2003 | Hilditch et al. |
| 6,644,412 | B2 | 11/2003 | Bode et al. |
| 6,691,781 | B2 | 2/2004 | Grant et al. |
| 6,719,048 | B1 | 4/2004 | Ramos et al. |
| 6,747,743 | B2 | 6/2004 | Skinner et al. |
| 6,851,473 | B2 | 2/2005 | Davidson |
| 6,976,507 | B1 | 12/2005 | Webb et al. |
| 7,025,134 | B2 | 4/2006 | Byrd et al. |
| 7,114,560 | B2 | 10/2006 | Nguyen et al. |
| 7,159,468 | B2 | 1/2007 | Skinner et al. |
| 7,185,706 | B2 | 3/2007 | Freyer |
| 7,213,650 | B2 | 5/2007 | Lehman et al. |
| 7,213,681 | B2 | 5/2007 | Birchak et al. |
| 7,216,738 | B2 | 5/2007 | Birchak et al. |
| 7,290,606 | B2 | 11/2007 | Coronado et al. |
| 7,318,471 | B2 | 1/2008 | Rodney et al. |
| 7,404,416 | B2 | 7/2008 | Schultz et al. |
| 7,405,998 | B2 | 7/2008 | Webb et al. |
| 7,409,999 | B2 | 8/2008 | Henriksen et al. |
| 7,413,010 | B2 | 8/2008 | Blauch et al. |
| 7,426,962 | B2 | 9/2008 | Moen |
| 7,511,823 | B2 | 3/2009 | Schultz et al. |
| 7,537,056 | B2 | 5/2009 | MacDougall |
| 2004/0256099 | A1 | 12/2004 | Nguyen et al. |
| 2007/0045038 | A1 | 3/2007 | Han et al. |
| 2007/0256828 | A1 | 11/2007 | Birchak et al. |
| 2008/0041580 | A1 | 2/2008 | Freyer et al. |
| 2008/0041581 | A1 | 2/2008 | Richards |
| 2008/0041582 | A1 | 2/2008 | Saetre et al. |
| 2008/0041588 | A1 | 2/2008 | Richards et al. |
| 2008/0149323 | A1 | 6/2008 | O'Malley et al. |
| 2008/0283238 | A1 | 11/2008 | Richards et al. |
| 2009/0008088 | A1 | 1/2009 | Schultz et al. |
| 2009/0008090 | A1 | 1/2009 | Schultz et al. |
| 2009/0009297 | A1 | 1/2009 | Shinohara et al. |
| 2009/0009333 | A1 | 1/2009 | Bhogal et al. |
| 2009/0009336 | A1 | 1/2009 | Ishikawa |
| 2009/0009412 | A1 | 1/2009 | Warther |
| 2009/0009437 | A1 | 1/2009 | Hwang et al. |
| 2009/0009445 | A1 | 1/2009 | Lee |
| 2009/0009447 | A1 | 1/2009 | Naka et al. |
| 2009/0065197 | A1 | 3/2009 | Eslinger |
| 2009/0078427 | A1 | 3/2009 | Patel |
| 2009/0078428 | A1 | 3/2009 | Ali |
| 2009/0101354 | A1 | 4/2009 | Holmes et al. |
| 2009/0133869 | A1 | 5/2009 | Clem |
| 2009/0151925 | A1 | 6/2009 | Richards et al. |
| 2009/0159282 | A1 | 6/2009 | Webb et al. |
| 2009/0250224 | A1 | 10/2009 | Wright et al. |
| 2009/0277639 | A1 | 11/2009 | Schultz et al. |
| 2009/0277650 | A1 | 11/2009 | Casciaro et al. |
| 2010/0101773 | A1 | 4/2010 | Nguyen et al. |
| 2011/0042091 | A1* | 2/2011 | Dykstra et al. ..... 166/316 |
| 2011/0042092 | A1 | 2/2011 | Fripp et al. |
| 2011/0186300 | A1 | 8/2011 | Dykstra et al. |

FOREIGN PATENT DOCUMENTS

| | | | |
|---|---|---|---|
| WO | 0214647 | A1 | 2/2002 |
| WO | 03062597 | A1 | 7/2003 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |

OTHER PUBLICATIONS

Office Action issued Nov. 26, 2010, for U.S. Appl. No. 11/958,466, 14 pages.

Office Action issued Jul. 28, 2010, for U.S. Appl. No. 11/958,466, 13 pages.

Wikipedia, Drag (physics), dated Jul. 8, 2010, 9 pages.

Advisory Action issued Dec. 27, 2013 for U.S. Appl. No. 12/792,095, 8 pages.

Office Action issued Oct. 11, 2013 for U.S. Appl. No. 12/792,095, 18 pages.

Office Action issued Oct. 22, 2013 for U.S. Appl. No. 12/983,150, 31 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

Office Action issued Jun. 26, 2011 for U.S. Appl. No. 12/791,993, 17 pages.

Halliburton Application and Drawings for U.S. Appl. No. 13/004,135, filed Jan. 11, 2011.

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Specification and Drawing for U.S. Appl. No. 10/650,186, filed date Aug. 28, 2003, 16 pages.

Apparatus and Method of Inducing Fluidic Oscillation in a Rotating Cleaning Nozzle, ip.com, dated Apr. 24, 2007, 3 pages.

OPYIMUX; "Fluidic Flowmeter", company brochure, receive Aug. 10, 2011.

Office Action issued Aug. 27, 2013 for U.S. Appl. No. 12/983,145, 29 pages.

Advisory Action issued Jan. 16, 2014 for U.S. Appl. No. 12/983,150, 3 pages.

* cited by examiner

VARIABLE FREQUENCY FLUID OSCILLATORS FOR USE WITH A SUBTERRANEAN WELL

BACKGROUND

This disclosure relates generally to equipment utilized and operations performed in conjunction with a subterranean well and, in an example described below, more particularly provides improved configurations of fluid oscillators.

There are many situations in which it would be desirable to produce oscillations in fluid flow in a well. For example, in steam flooding operations, pulsations in flow of the injected steam can enhance sweep efficiency. In production operations, pressure fluctuations can encourage flow of hydrocarbons through rock pores, and pulsating jets can be used to clean well screens. In stimulation operations, pulsating jet flow can be used to initiate fractures in formations. These are just a few examples of a wide variety of possible applications for oscillating fluid flow.

Therefore, it will be appreciated that improvements would be beneficial in the art of constructing fluid oscillators.

SUMMARY

In the disclosure below, a well tool with uniquely configured fluid oscillators is provided which brings improvements to the art. One example is described below in which a fluidic oscillator includes a fluid switch and a vortex chamber. Another example is described below in which fluid paths in the fluidic oscillator cross each other. Yet another example is described in which multiple oscillators are used to produce repeated variations in frequency of discharge of fluid from the well tool.

In one aspect, a well tool is provided to the art. In one example, the well tool can include an oscillator which varies a flow rate of fluid through the oscillator, and another oscillator which varies a frequency of discharge of the fluid received from the first oscillator.

In another aspect, a method is described below. The method can include flowing a fluid through an oscillator, thereby repeatedly varying a flow rate of fluid discharged from the oscillator, and receiving the fluid from the first oscillator into a second oscillator.

In yet another aspect, a well tool is provided by this disclosure. In one example described below, the well tool can include an oscillator including a vortex chamber, and another oscillator which receives fluid flowed through the vortex chamber.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
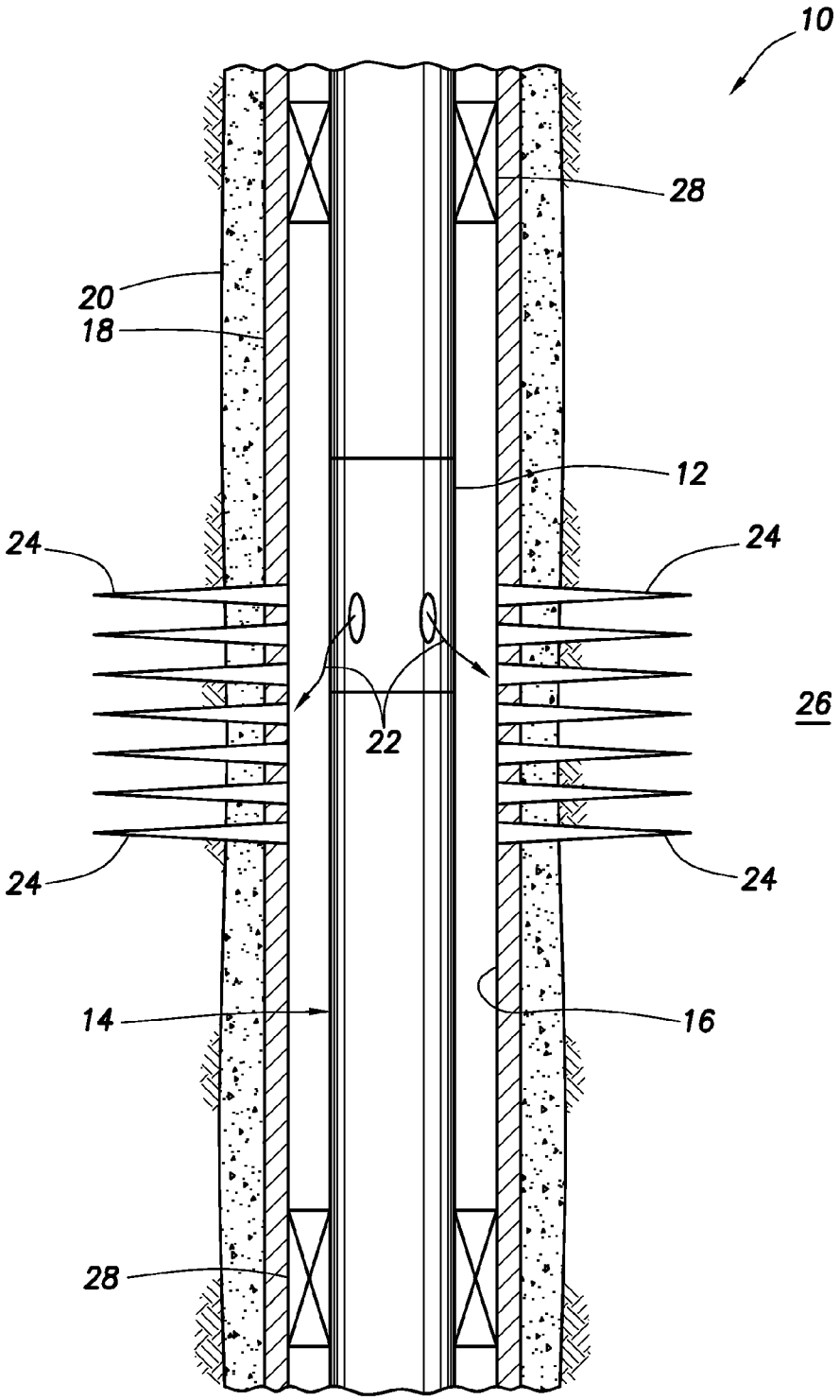
FIG. 1 is a representative partially cross-sectional view of a well system and associated method which can embody principles of the present disclosure.

Representatively illustrated in FIG. 1 is a well system 10 and associated method which can embody principles of this disclosure. In this example, a well tool 12 is interconnected in a tubular string 14 installed in a wellbore 16. The wellbore 16 is lined with casing 18 and cement 20. The well tool 12 is used to produce oscillations in flow of fluid 22 injected through perforations 24 into a formation 26 penetrated by the wellbore 16.

The fluid 22 could be steam, water, gas, fluid previously produced from the formation 26, fluid produced from another formation or another interval of the formation 26, or any other type of fluid from any source. It is not necessary, however, for the fluid 22 to be flowed outward into the formation 26 or outward through the well tool 12, since the principles of this disclosure are also applicable to situations in which fluid is produced from a formation, or in which fluid is flowed inwardly through a well tool.

Broadly speaking, this disclosure is not limited at all to the one example depicted in FIG. 1 and described herein. Instead, this disclosure is applicable to a variety of different circumstances in which, for example, the wellbore 16 is not cased or cemented, the well tool 12 is not interconnected in a tubular string 14 secured by packers 28 in the wellbore, etc.

Figure 2:
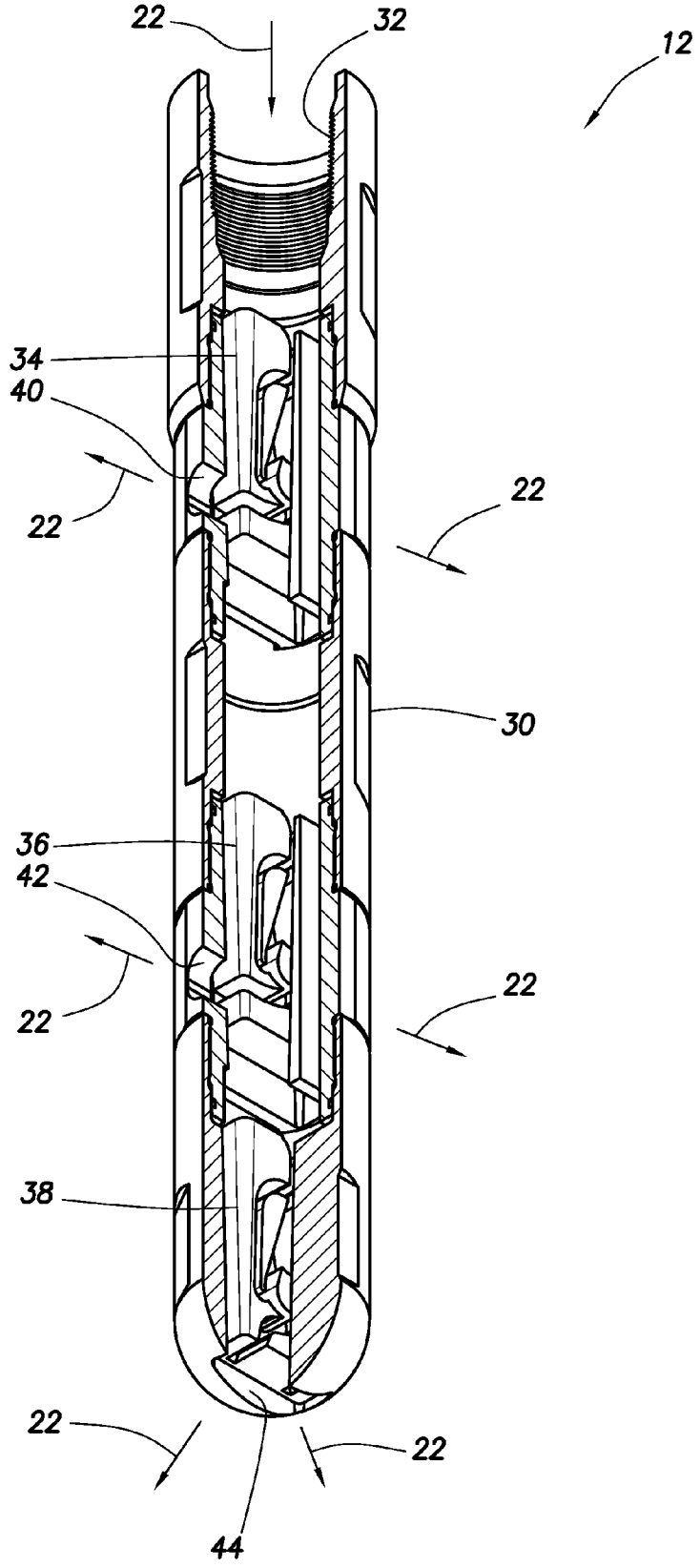
FIG. 2 is a representative partially cross-sectional isometric view of a well tool which may be used in the well system and method of FIG. 1.

Referring additionally now to FIG. 2, an example of the well tool 12 which may be used in the system 10 and method of FIG. 1 is representatively illustrated. However, the well tool 12 could be used in other systems and methods, in keeping with the scope of this disclosure.

The well tool 12 depicted in FIG. 2 has an outer housing assembly 30 with a threaded connector 32 at an upper end thereof. This example is configured for attachment at a lower end of a tubular string, and so there is not another connector at a lower end of the housing assembly 30, but one could be provided if desired.

Secured within the housing assembly 30 are three inserts 34, 36, 38. The inserts 34, 36, 38 produce oscillations in the flow of the fluid 22 through the well tool 12.

More specifically, the upper insert 34 produces oscillations in the flow of the fluid 22 outwardly through two opposing ports 40 (only one of which is visible in FIG. 2) in the housing assembly 30. The middle insert 36 produces oscillations in the flow of the fluid 22 outwardly through two opposing ports 42 (only one of which is visible in FIG. 2). The lower insert 38 produces oscillations in the flow of the fluid 22 outwardly through a port 44 in the lower end of the housing assembly 30.

Of course, other numbers and arrangements of inserts and ports, and other directions of fluid flow may be used in other examples. FIG. 2 depicts merely one example of a possible configuration of the well tool 12.

Figure 3:
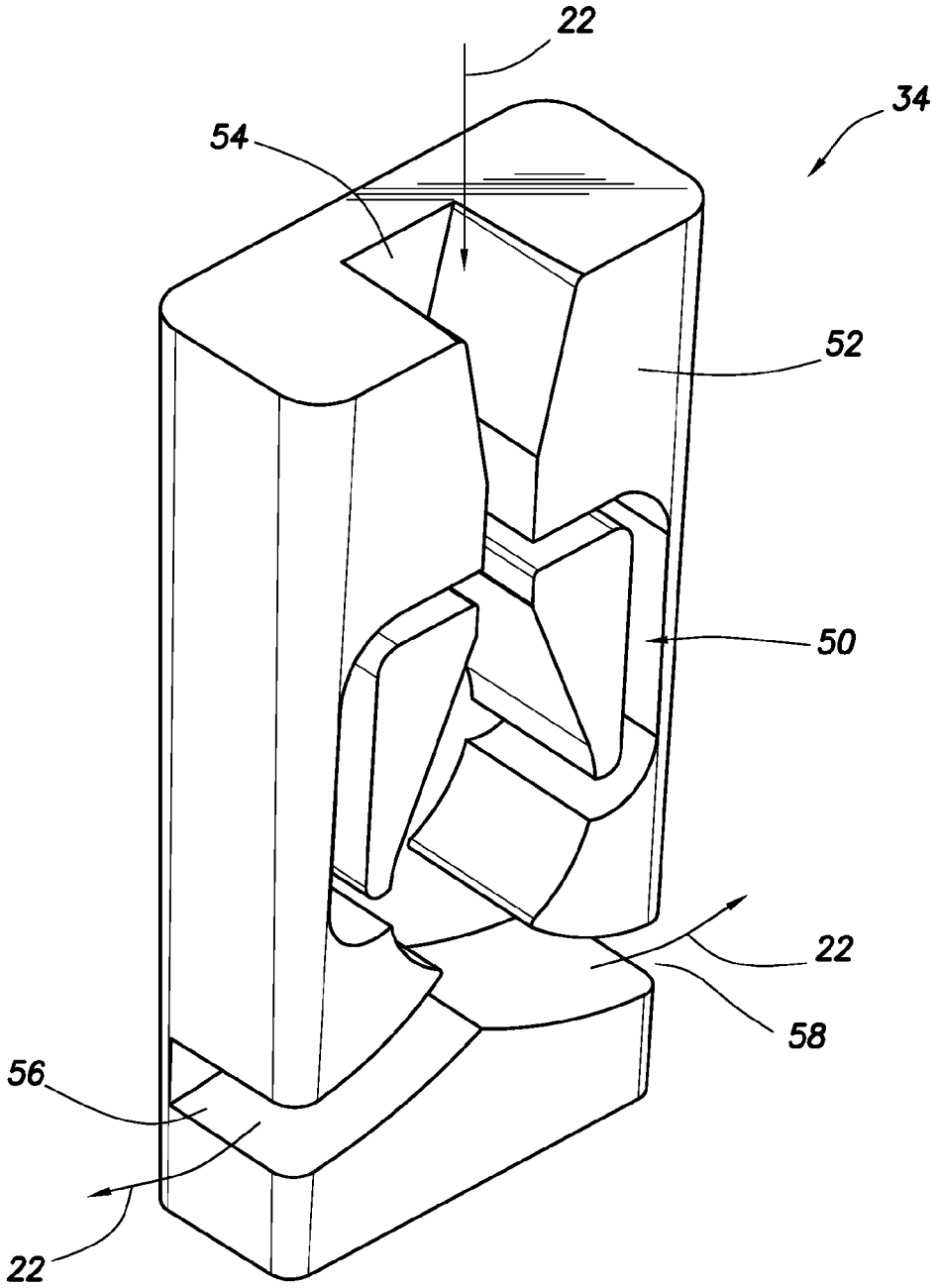
FIG. 3 is a representative isometric view of an insert which may be used in the well tool of FIG. 2.

Referring additionally now to FIG. 3, an enlarged scale view of one example of the insert 34 is representatively illustrated. The insert 34 may be used in the well tool 12 described above, or it may be used in other well tools in keeping with the scope of this disclosure.

The insert 34 depicted in FIG. 3 has a fluidic oscillator 50 machined, molded, cast or otherwise formed therein. In this example, the fluidic oscillator 50 is formed into a generally planar side 52 of the insert 34, and that side is closed off when the insert is installed in the well tool 12, so that the fluid oscillator is enclosed between its fluid input 54 and two fluid outputs 56, 58.

The fluid 22 flows into the fluidic oscillator 50 via the fluid input 54, and at least a majority of the fluid 22 alternately flows through the two fluid outputs 56, 58. That is, the majority of the fluid 22 flows outwardly via the fluid output 56, then it flows outwardly via the fluid output 58, then it flows outwardly through the fluid output 56, then through the fluid output 58, etc., back and forth repeatedly.

In the example of FIG. 3, the fluid outputs 56, 58 are oppositely directed (e.g., facing about 180 degrees relative to one another), so that the fluid 22 is alternately discharged from the fluidic oscillator 50 in opposite directions. In other examples (including some of those described below), the fluid outputs 56, 58 could be otherwise directed.

It also is not necessary for the fluid outputs 56, 58 to be structurally separated as in the example of FIG. 3. Instead, the fluid outputs 56, 58 could be different areas of a larger output opening, as in the example of FIG. 7 described more fully below.

Figure 4:
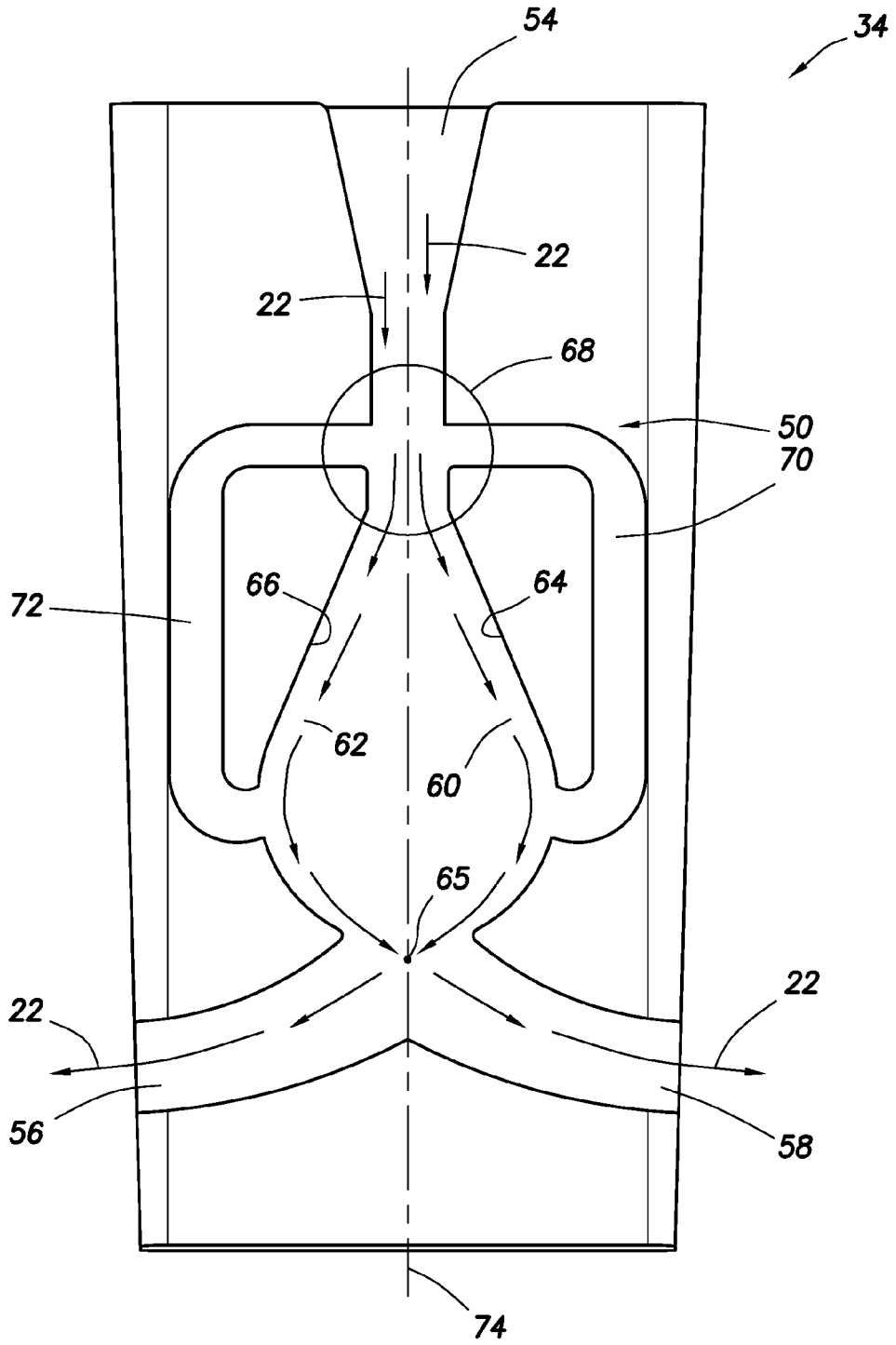
FIG. 4 is a representative elevational view of a fluidic oscillator formed in the insert of FIG. 3, which fluidic oscillator can embody principles of this disclosure.

Referring additionally now to FIG. 4, the fluidic oscillator 50 is representatively illustrated in an elevational view of the insert 34. However, it should be clearly understood that it is not necessary for the fluid oscillator 50 to be positioned in the insert 34 as depicted in FIG. 4, and the fluidic oscillator could be positioned in other inserts (such as the inserts 36, 38, etc.) or in other devices, in keeping with the principles of this disclosure.

The fluid 22 is received into the fluidic oscillator 50 via the inlet 54, and a majority of the fluid flows from the inlet to either the outlet 56 or the outlet 58 at any given point in time. The fluid 22 flows from the inlet 54 to the outlet 56 via one fluid path 60, and the fluid flows from the inlet to the other outlet 58 via another fluid path 62.

In one feature of this example of the fluidic oscillator 50, the two fluid paths 60, 62 cross each other at a crossing 65. A location of the crossing 65 is determined by shapes of walls 64, 66 of the fluidic oscillator 50 which outwardly bound the fluid paths 60, 62.

When a majority of the fluid 22 flows via the fluid path 60, the well-known Coanda effect tends to maintain the flow adjacent the wall 64. When a majority of the fluid 22 flows via the fluid path 62, the Coanda effect tends to maintain the flow adjacent the wall 66.

A fluid switch 68 is used to alternate the flow of the fluid 22 between the two fluid paths 60, 62. The fluid switch 68 is formed at an intersection between the inlet 54 and the two fluid paths 60, 62.

A feedback fluid path 70 is connected between the fluid switch 68 and the fluid path 60 downstream of the fluid switch and upstream of the crossing 65. Another feedback fluid path 72 is connected between the fluid switch 68 and the fluid path 62 downstream of the fluid switch and upstream of the crossing 65.

When pressure in the feedback fluid path 72 is greater than pressure in the other feedback fluid path 70, the fluid 22 will be influenced to flow toward the fluid path 60. When pressure in the feedback fluid path 70 is greater than pressure in the other feedback fluid path 72, the fluid 22 will be influenced to flow toward the fluid path 62. These relative pressure conditions are alternated back and forth, resulting in a majority of the fluid 22 flowing alternately via the fluid paths 60, 62.

For example, if initially a majority of the fluid 22 flows via the fluid path 60 (with the Coanda effect acting to maintain the fluid flow adjacent the wall 64), pressure in the feedback fluid path 70 will become greater than pressure in the feedback fluid path 72. This will result in the fluid 22 being influenced (in the fluid switch 68) to flow via the other fluid path 62.

When a majority of the fluid 22 flows via the fluid path 62 (with the Coanda effect acting to maintain the fluid flow adjacent the wall 66), pressure in the feedback fluid path 72 will become greater than pressure in the feedback fluid path 70. This will result in the fluid 22 being influenced (in the fluid switch 68) to flow via the other fluid path 60.

Thus, a majority of the fluid 22 will alternate between flowing via the fluid path 60 and flowing via the fluid path 62. Note that, although the fluid 22 is depicted in FIG. 4 as simultaneously flowing via both of the fluid paths 60, 62, in practice a majority of the fluid 22 will flow via only one of the fluid paths at a time.

Note that the fluidic oscillator 50 of FIG. 4 is generally symmetrical about a longitudinal axis 74. The fluid outputs 56, 58 are on opposite sides of the longitudinal axis 74, the feedback fluid paths 70, 72 are on opposite sides of the longitudinal axis, etc.

Figure 5:
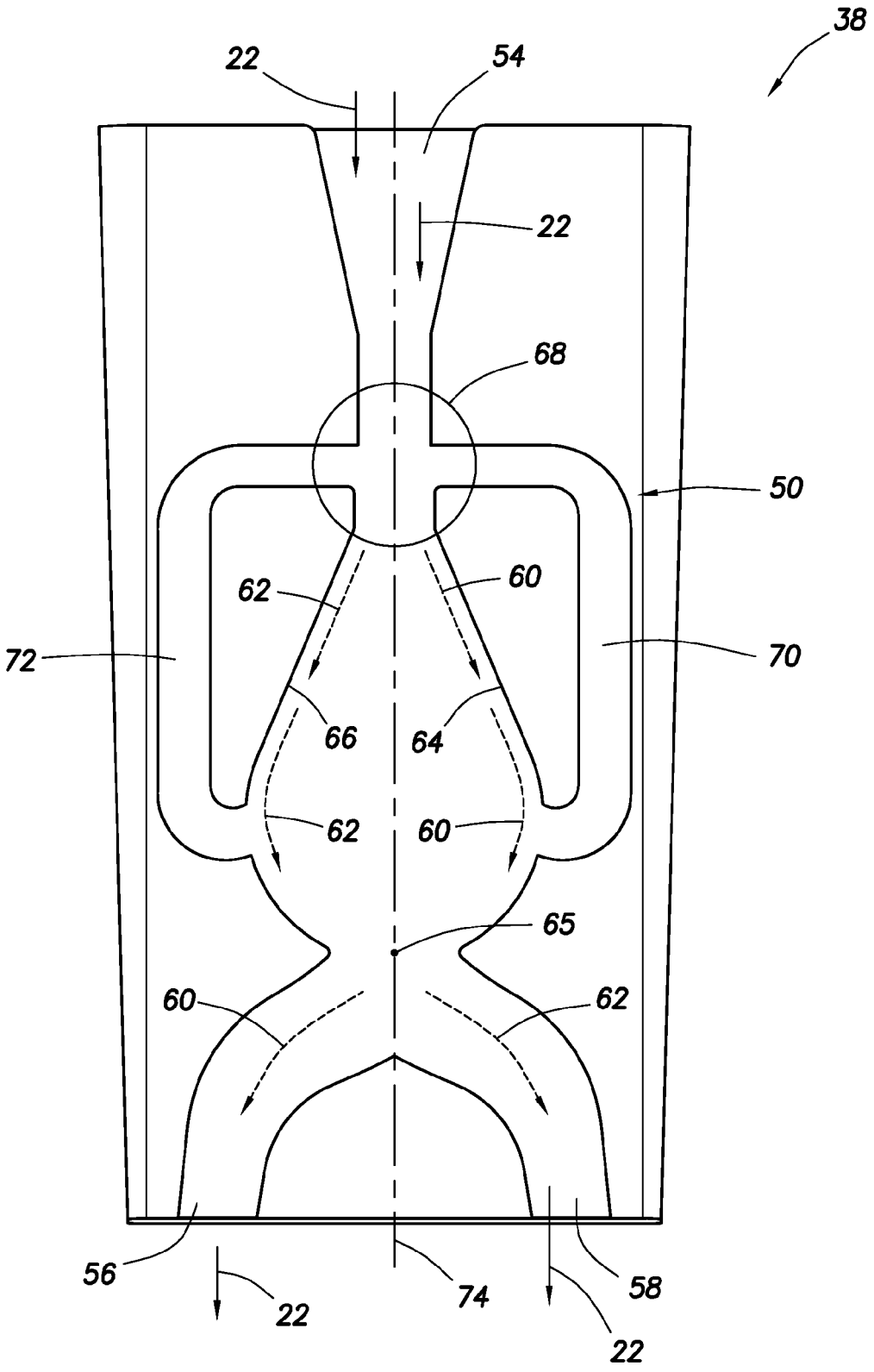
FIGS. 5-10 are additional configurations of the fluidic oscillator.

Referring additionally now to FIG. 5, another configuration of the fluidic oscillator 50 is representatively illustrated. In this configuration, the fluid outputs 56, 58 are not oppositely directed.

Instead, the fluid outputs 56, 58 discharge the fluid 22 in the same general direction (downward as viewed in FIG. 5). As such, the fluidic oscillator 50 of FIG. 5 would be appropriately configured for use in the lower insert 38 in the well tool 12 of FIG. 2.

Figure 6:
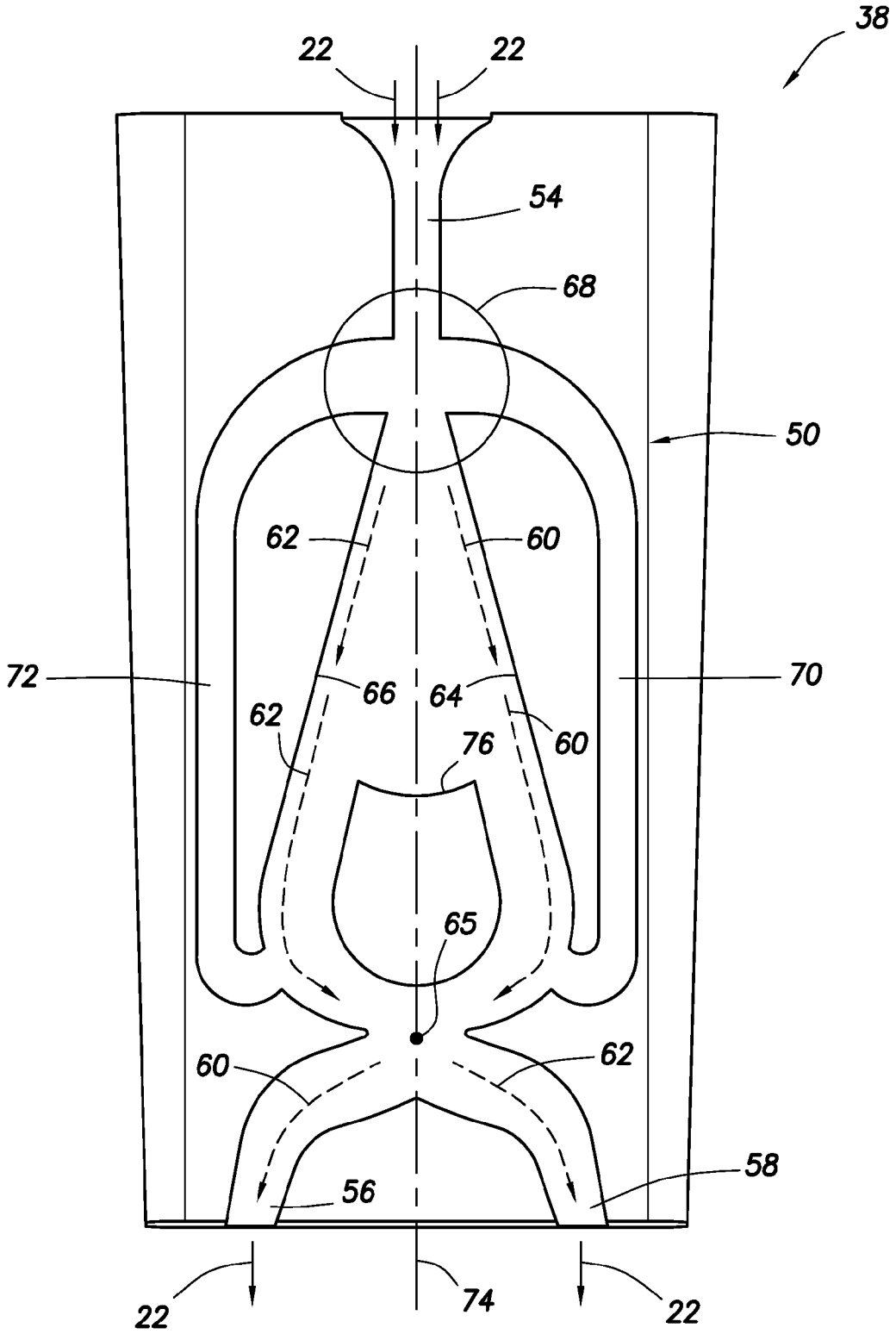

Referring additionally now to FIG. 6, another configuration of the fluidic oscillator 50 is representatively illustrated. In this configuration, a structure 76 is interposed between the fluid paths 60, 62 just upstream of the crossing 65.

The structure 76 beneficially reduces a flow area of each of the fluid paths 60, 62 upstream of the crossing 65, thereby increasing a velocity of the fluid 22 through the crossing and somewhat increasing the fluid pressure in the respective feedback fluid paths 70, 72.

This increased pressure is alternately present in the feedback fluid paths 70, 72, thereby producing more positive switching of fluid paths 60, 62 in the fluid switch 68. In addition, when initiating flow of the fluid 22 through the fluidic oscillator 50, an increased pressure difference between the feedback fluid paths 70, 72 helps to initiate the desired switching back and forth between the fluid paths 60, 62.

Figure 7:
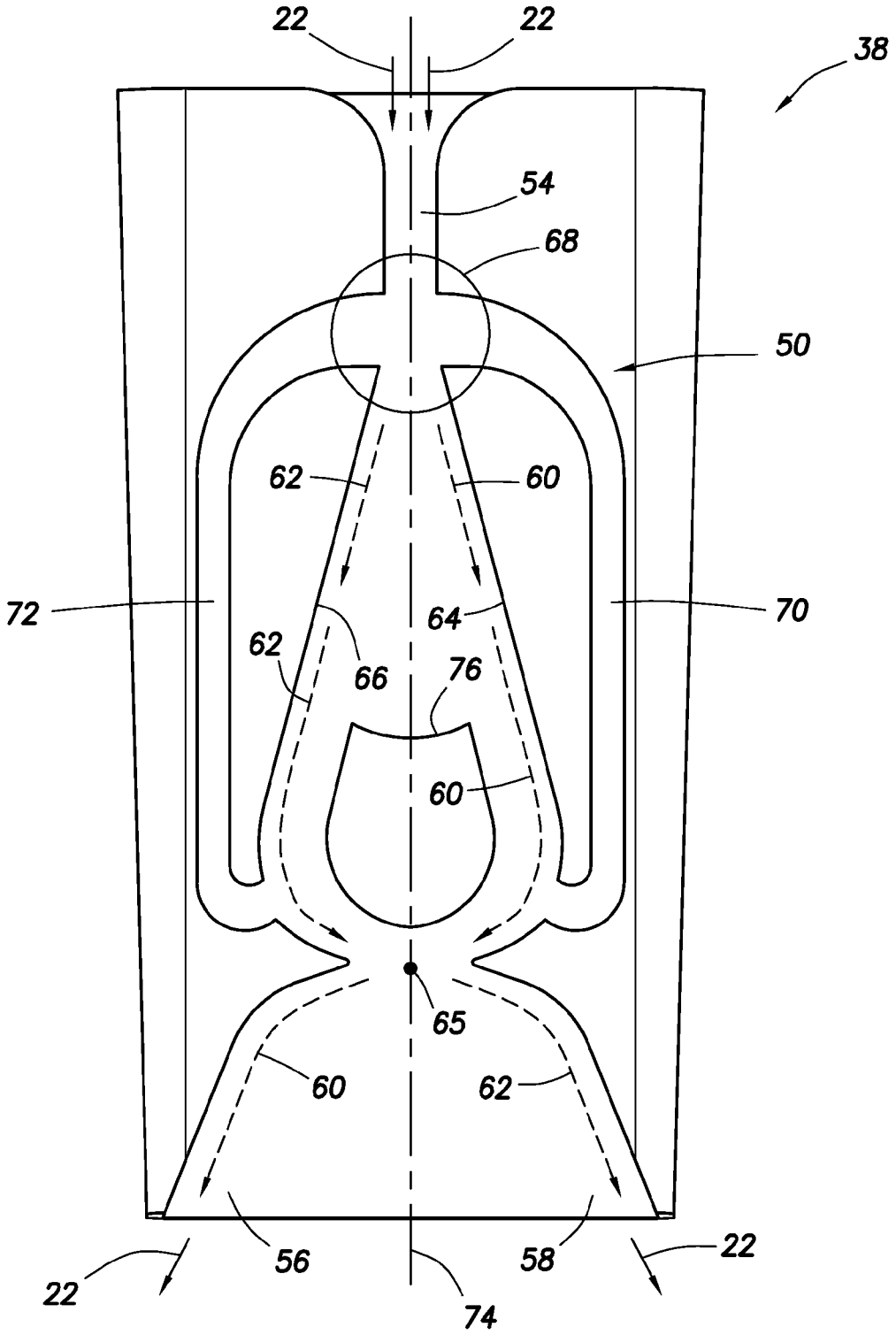

Referring additionally now to FIG. 7, another configuration of the fluidic oscillator 50 is representatively illustrated. In this configuration, the fluid outputs 56, 58 are not separated by any structure.

However, a majority of the fluid 22 will exit the fluidic oscillator 50 of FIG. 7 via either the fluid path 60 or the fluid path 62 at any given time. Therefore, the fluid outputs 56, 58 are defined by the regions of the fluidic oscillator 50 via which the fluid 22 exits the fluidic oscillator along the respective fluid paths 60, 62.

Figure 8:
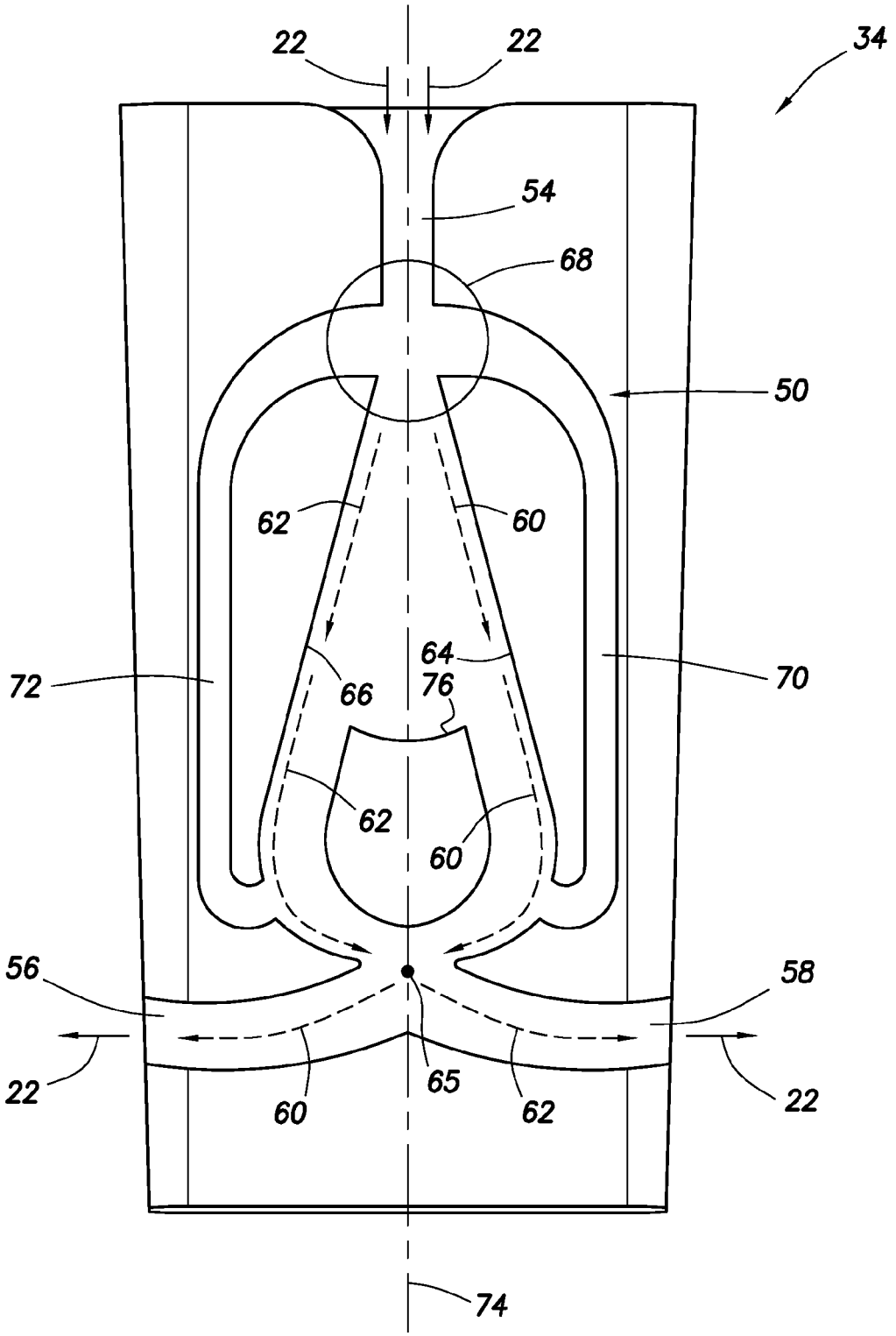

Referring additionally now to FIG. 8, another configuration of the fluidic oscillator is representatively illustrated. In this configuration, the fluid outputs 56, 58 are oppositely directed, similar to the configuration of FIG. 4, but the structure 76 is interposed between the fluid paths 60, 62, similar to the configuration of FIGS. 6 & 7.

Thus, the FIG. 8 configuration can be considered a combination of the FIGS. 4 & 6 configurations. This demonstrates that any of the features of any of the configurations described herein can be used in combination with any of the other configurations, in keeping with the principles of this disclosure.

Figure 9:
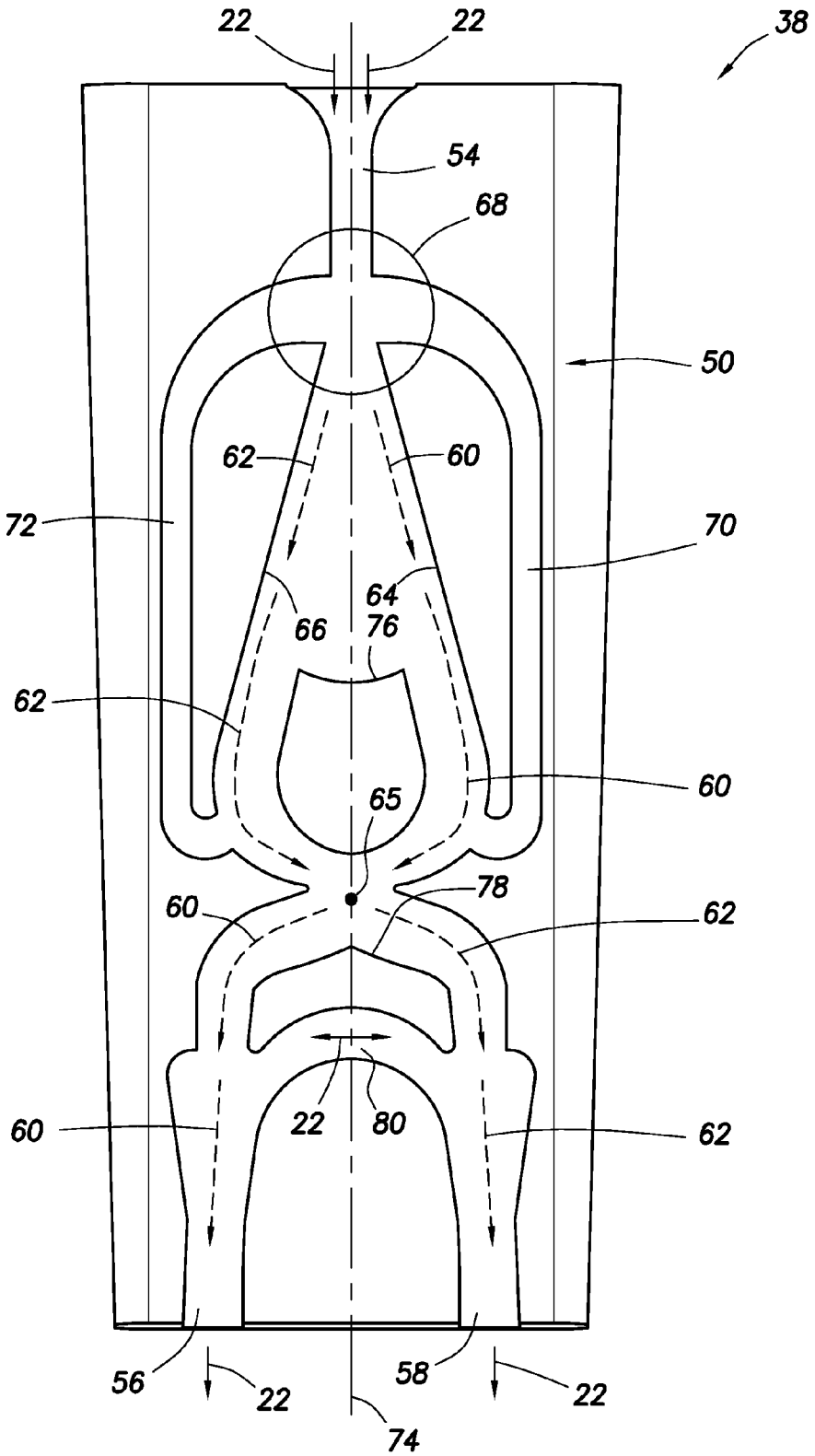

Referring additionally now to FIG. 9, another configuration of the fluidic oscillator 50 is representatively illustrated. In this configuration, another structure 78 is interposed between the fluid paths 60, 62 downstream of the crossing 65.

The structure 78 reduces the flow areas of the fluid paths 60, 62 just upstream of a fluid path 80 which connects the fluid paths 60, 62. The velocity of the fluid 22 flowing through the fluid paths 60, 62 is increased due to the reduced flow areas of the fluid paths.

The increased velocity of the fluid 22 flowing through each of the fluid paths 60, 62 can function to draw some fluid from the other of the fluid paths. For example, when a majority of the fluid 22 flows via the fluid path 60, its increased velocity due to the presence of the structure 78 can draw some fluid through the fluid path 80 into the fluid path 60. When a majority of the fluid 22 flows via the fluid path 62, its increased velocity due to the presence of the structure 78 can draw some fluid through the fluid path 80 into the fluid path 62.

It is possible that, properly designed, this can result in more fluid being alternately discharged from the fluid outputs 56, 58 than fluid 22 being flowed into the input 54. Thus, fluid can be drawn into one of the outputs 56, 58 while fluid is being discharged from the other of the outputs 56, 58.

Figure 10:
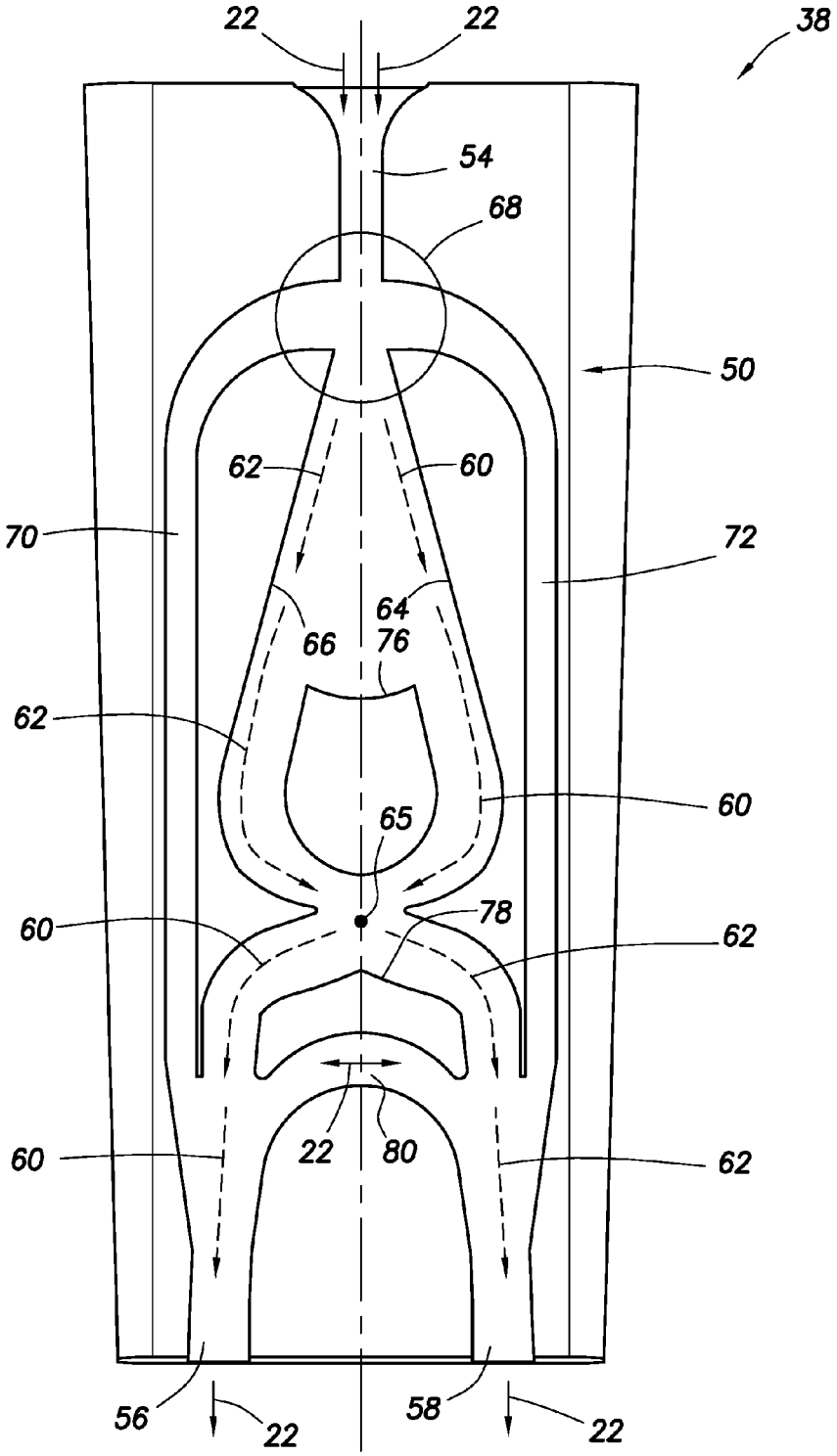

Referring additionally now to FIG. 10, another configuration of the fluidic oscillator 50 is representatively illustrated. In this configuration, computational fluid dynamics modeling has shown that a flow rate of fluid discharged from one of the outputs 56, 58 can be greater than a flow rate of fluid 22 directed into the input 54.

Fluid can be drawn from one of the outputs 56, 58 to the other output via the fluid path 80. Thus, fluid can enter one of the outputs 56, 58 while fluid is being discharged from the other output.

This is due in large part to the increased velocity of the fluid 22 caused by the structure 78 (e.g., the increased velocity of the fluid in one of the fluid paths 60, 62 causes eduction of fluid from the other of the fluid paths 60, 62 via the fluid path 80). At the intersections between the fluid paths 60, 62 and the respective feedback fluid paths 70, 72, pressure can be significantly reduced due to the increased velocity, thereby reducing pressure in the respective feedback fluid paths.

In the FIG. 10 example, a reduction in pressure in the feedback fluid path 70 will influence the fluid 22 to flow via the fluid path 62 from the fluid switch 68 (due to the relatively higher pressure in the other feedback fluid path 72). Similarly, a reduction in pressure in the feedback fluid path 72 will influence the fluid 22 to flow via the fluid path 60 from the fluid switch 68 (due to the relatively higher pressure in the other feedback fluid path 70).

One difference between the FIGS. 9 & 10 configurations is that, in the FIG. 10 configuration, the feedback fluid paths 70, 72 are connected to the respective fluid paths 60, 62 downstream of the crossing 65. Computational fluid dynamics modeling has shown that this arrangement produces desirably low frequency oscillations of flow from the outputs 56, 58, although such low frequency oscillations are not necessary in keeping with the principles of this disclosure.

Referring additionally now to FIGS. 11-19, another configuration of the fluidic oscillator 50 is representatively illustrated. As with the other configurations described herein, the fluidic oscillator 50 of FIGS. 11-19 can be used with the well tool 12 in the well system 10 and associated method, or the fluidic oscillator can be used with other well systems, well tools and methods.

In the FIGS. 11-19 configuration, the fluidic oscillator 50 includes a vortex chamber 80 having two inlets 82, 84. When the fluid 22 flows along the fluid path 60, the fluid enters the vortex chamber 80 via the inlet 82. When the fluid 22 flows along the fluid path 62, the fluid enters the vortex chamber 80 via the inlet 84.

The crossing 65 is depicted as being at an intersection of the inlets 82, 84 and the vortex chamber 80. However, the crossing 65 could be at another location, could be before or after the inlets 82, 84 intersect the vortex chamber 80, etc. It is not necessary for the inlets 82, 84 and the vortex chamber 80 to intersect at only a single location.

The inlets 82, 84 direct the fluid 22 to flow into the vortex chamber 80 in opposite circumferential directions. A tendency of the fluid 22 to flow circumferentially about the chamber 80 after entering via the inlets 82, 84 is related to many factors, such as, a velocity of the fluid, a density of the fluid, a viscosity of the fluid, a pressure differential between the input 54 and the output 56, a flow rate of the fluid between the input and the outlet, etc.

As the fluid 22 flows more radially from the inlets 82, 84 to the output 56, the pressure differential between the input 54 and the output 56 decreases, and a flow rate from the input to the output increases. As the fluid 22 flows more circumferentially about the chamber 80, the pressure differential between the input 54 and the output 56 increases, and the flow rate from the input to the output decreases.

This fluidic oscillator 50 takes advantage of a lag between the fluid 22 entering the vortex chamber 80 and full development of a vortex (spiraling flow of the fluid from the inlets 82, 84 to the output 56) in the vortex chamber. The feedback fluid paths 70, 72 are connected between the fluid switch 68 and the vortex chamber 80, so that the fluid switch will respond (at least partially) to creation or dissipation of a vortex in the vortex chamber.

Figure 11:
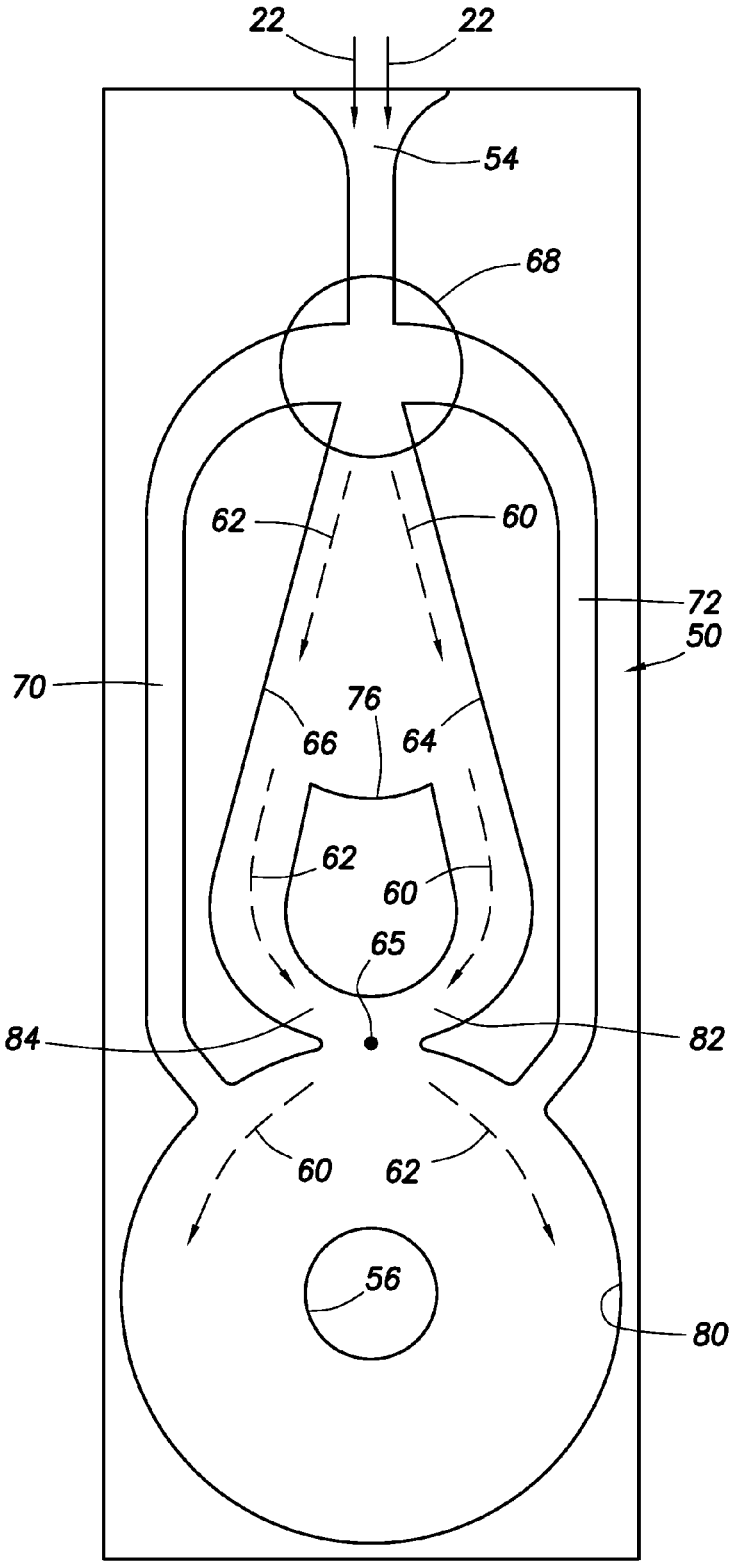
FIGS. 11-19 are representative partially cross-sectional views of another configuration of the fluidic oscillator.

FIGS. 12-19 representatively illustrate how the fluidic oscillator 50 of FIG. 11 creates pressure and/or flow rate oscillations in the fluid 22. As with the other fluidic oscillator 50 configurations described herein, such pressure and/or flow rate oscillations can be used for a variety of purposes. Some of these purposes can include: 1) to preferentially flow a desired fluid, 2) to reduce flow of an undesired fluid, 3) to determine viscosity of the fluid 22, 4) to determine the composition of the fluid, 5) to cut through a formation or other material with pulsating jets, 6) to generate electricity in response to vibrations or force oscillations, 7) to produce pressure and/or flow rate oscillations in produced or injected fluid flow, 8) for telemetry (e.g., to transmit signals via pressure and/or flow rate oscillations), 9) as a pressure drive for a hydraulic motor, 10) to clean well screens with pulsating flow, 11) to clean other surfaces with pulsating jets, 12) to promote uniformity of a gravel pack, 13) to enhance stimulation operations (e.g., acidizing, conformance or consolidation treatments, etc.), 14) any other operation which can be enhanced by oscillating flow rate, pressure, and/or force or displacement produced by oscillating flow rate and/or pressure, etc.

When the fluid 22 begins flowing through the fluidic oscillator 50 of FIG. 11, a fluid jet will be formed which extends through the fluid switch 68. Eventually, due to the Coanda effect, the fluid jet will tend to flow adjacent one of the walls 64, 66.

Assume for this example that the fluid jet eventually flows adjacent the wall 66. Because of this, a majority of the fluid 22 will flow along the fluid path 62.

A majority of the fluid 22 will, thus, enter the vortex chamber 80 via the inlet 84. At this point, a vortex has not yet formed in the vortex chamber 80, and so a pressure differential from the input 54 to the output 56 is relatively low, and a flow rate of the fluid through the fluidic oscillator 50 is relatively high.

The fluid 22 can flow substantially radially from the inlet 84 to the outlet 56. Eventually, however, a vortex does form in the vortex chamber 80 and resistance to flow through the vortex chamber is thereby increased.

Figure 12:
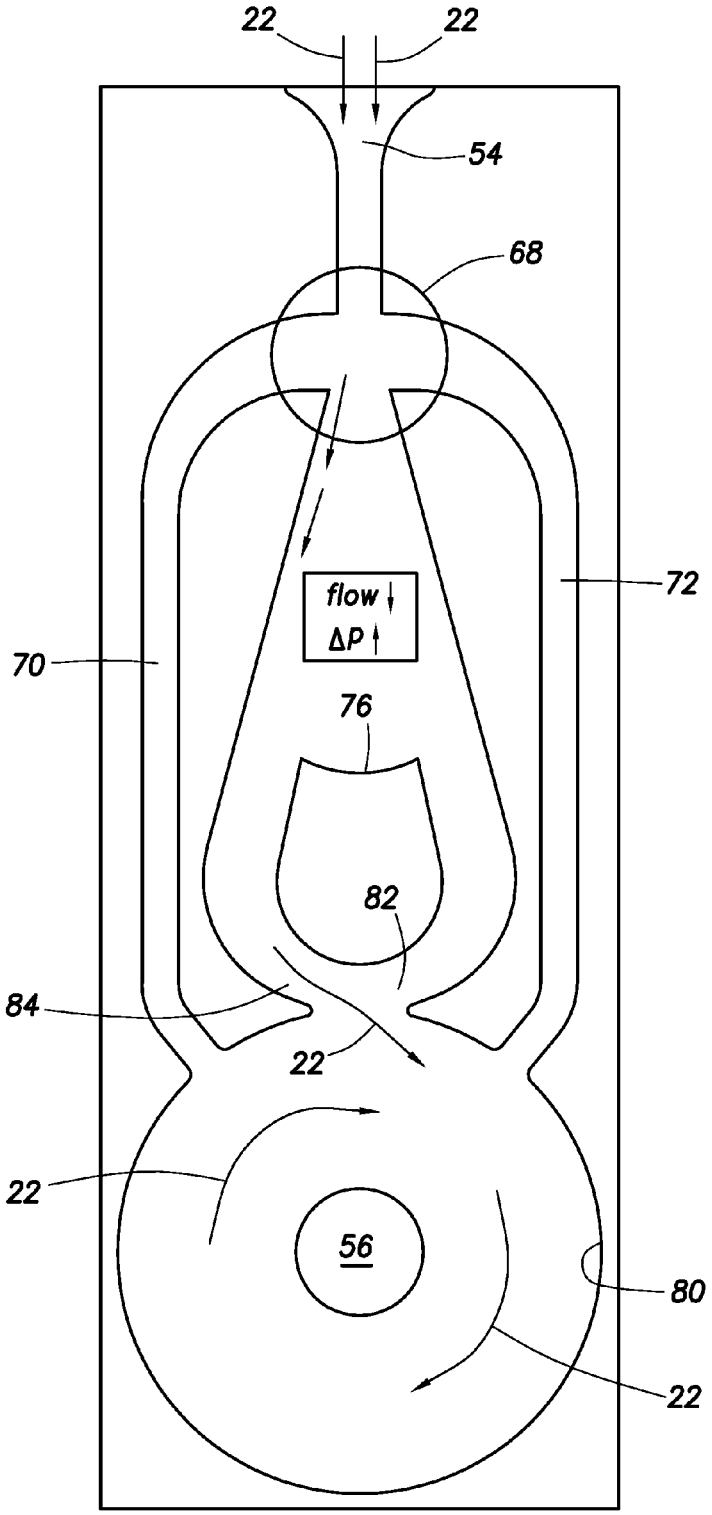

In FIG. 12, the fluidic oscillator 50 is depicted after a vortex has formed in the chamber 80. The fluid 22 now flows substantially circumferentially about the chamber 80 before exiting via the output 56.

The vortex is increasing in strength in the chamber 80, and so the fluid 22 is flowing more circumferentially about the chamber (in the clockwise direction as viewed in FIG. 12). A resistance to flow through the vortex chamber 80 results, and the pressure differential from the input 54 to the output 56 increases and/or the flow rate of the fluid 22 through the fluidic oscillator 50 decreases.

Figure 13:
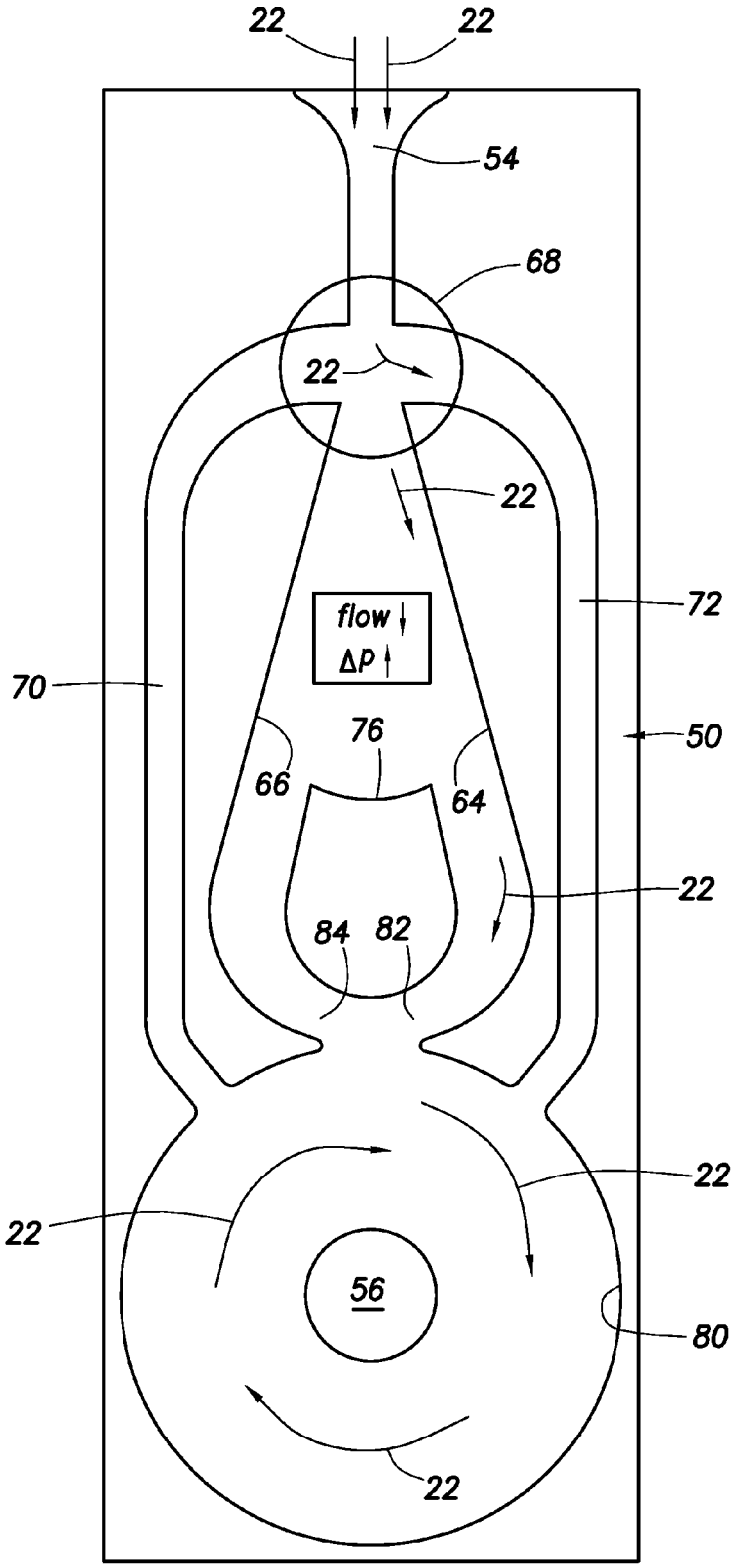

In FIG. 13, the vortex in the chamber 80 has reached maximum strength. Resistance to flow through the vortex chamber is at its maximum. Pressure differential from the input 54 to the output 56 may be at its maximum. The flow rate of the fluid 22 through the fluidic oscillator 50 may be at its minimum.

Eventually, however, due to the flow of the fluid 22 past the connection between the feedback fluid path 72 and the chamber 80, some of the fluid begins to flow from the fluid switch 68 to the chamber via the feedback fluid path 72. The fluid 22 also begins to flow adjacent the wall 64.

The vortex in the chamber 80 will begin to dissipate. As the vortex dissipates, the resistance to flow through the chamber 80 decreases.

Figure 14:
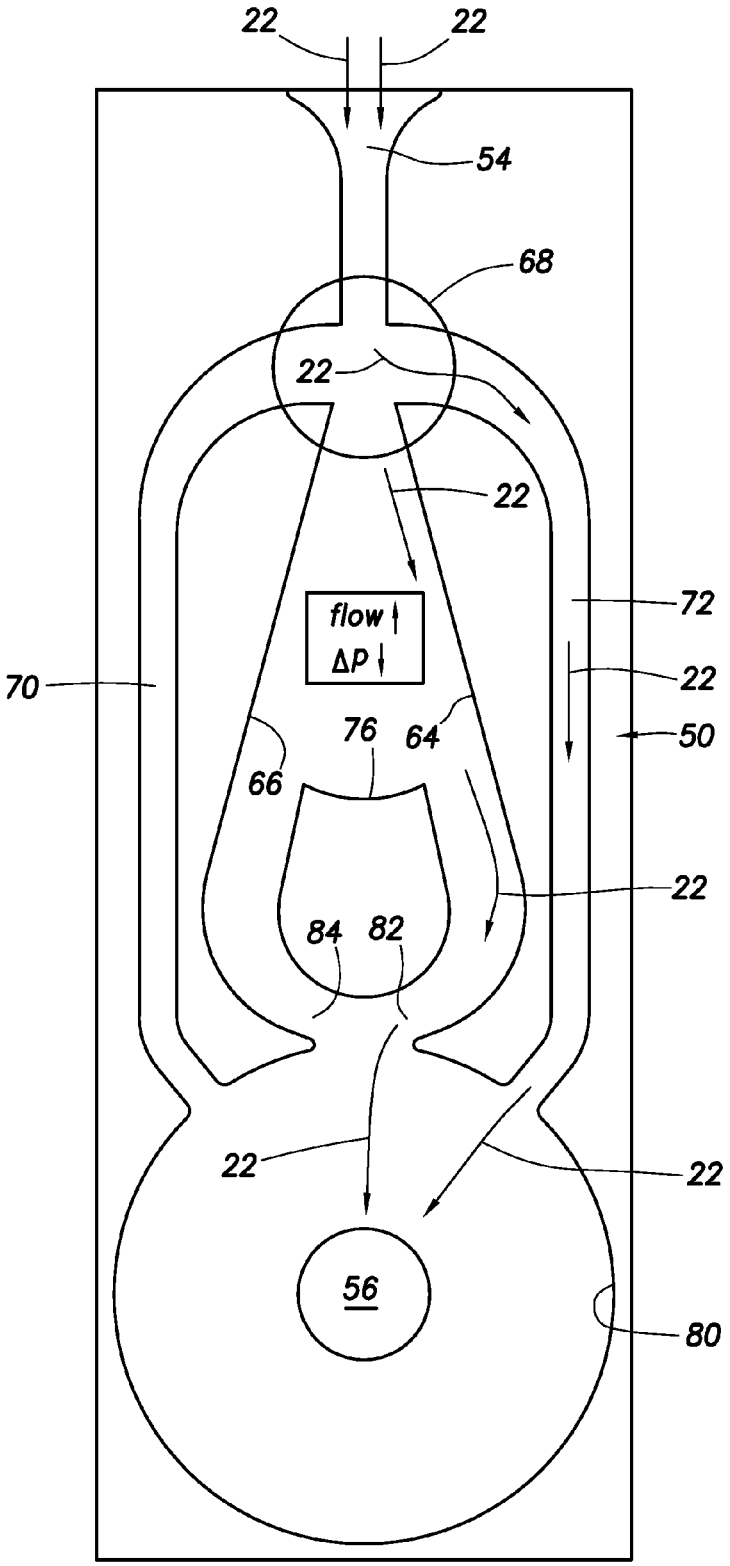

In FIG. 14, the vortex has dissipated in the chamber 80. The fluid 22 can now flow into the chamber 80 via the inlet 82 and the feedback fluid path 72.

The fluid 22 can flow substantially radially from the inlet 82 and feedback fluid path 72 to the output 56. Resistance to flow through the vortex chamber 80 is at its minimum. Pressure differential from the input 54 to the output 56 may be at its minimum. The flow rate of the fluid 22 through the fluidic oscillator 50 may be at its maximum.

Eventually, however, a vortex does form in the vortex chamber 80 and resistance to flow through the vortex chamber will thereby increase. As the strength of the vortex increases, the resistance to flow through the vortex chamber 80 increases, and the pressure differential from the input 54 to the output 56 increases and/or the rate of flow of the fluid 22 through the fluidic oscillator 50 decreases.

Figure 15:
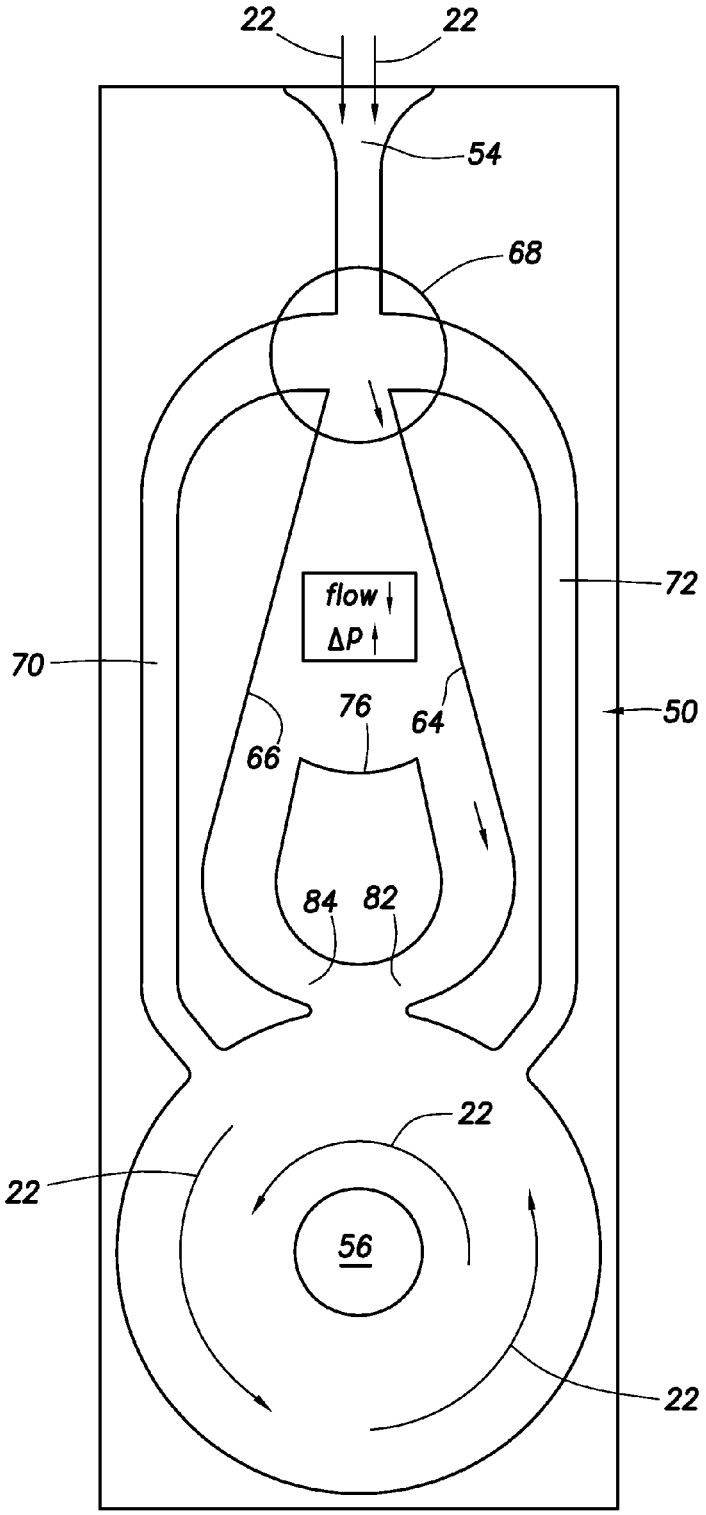

In FIG. 15, the vortex is at its maximum strength in the chamber 80. The fluid 22 flows substantially circumferentially about the chamber 80 (in a counter-clockwise direction as viewed in FIG. 15). Resistance to flow through the vortex chamber 80 is at its maximum. Pressure differential from the input 54 to the output 56 may be at its maximum. The flow rate of the fluid 22 through the fluidic oscillator 50 may be at its minimum.

Eventually, however, due to the flow of the fluid 22 past the connection between the feedback fluid path 70 and the chamber 80, some of the fluid begins to flow from the fluid switch 68 to the chamber via the feedback fluid path 70. The fluid 22 also begins to flow adjacent the wall 66.

Figure 16:
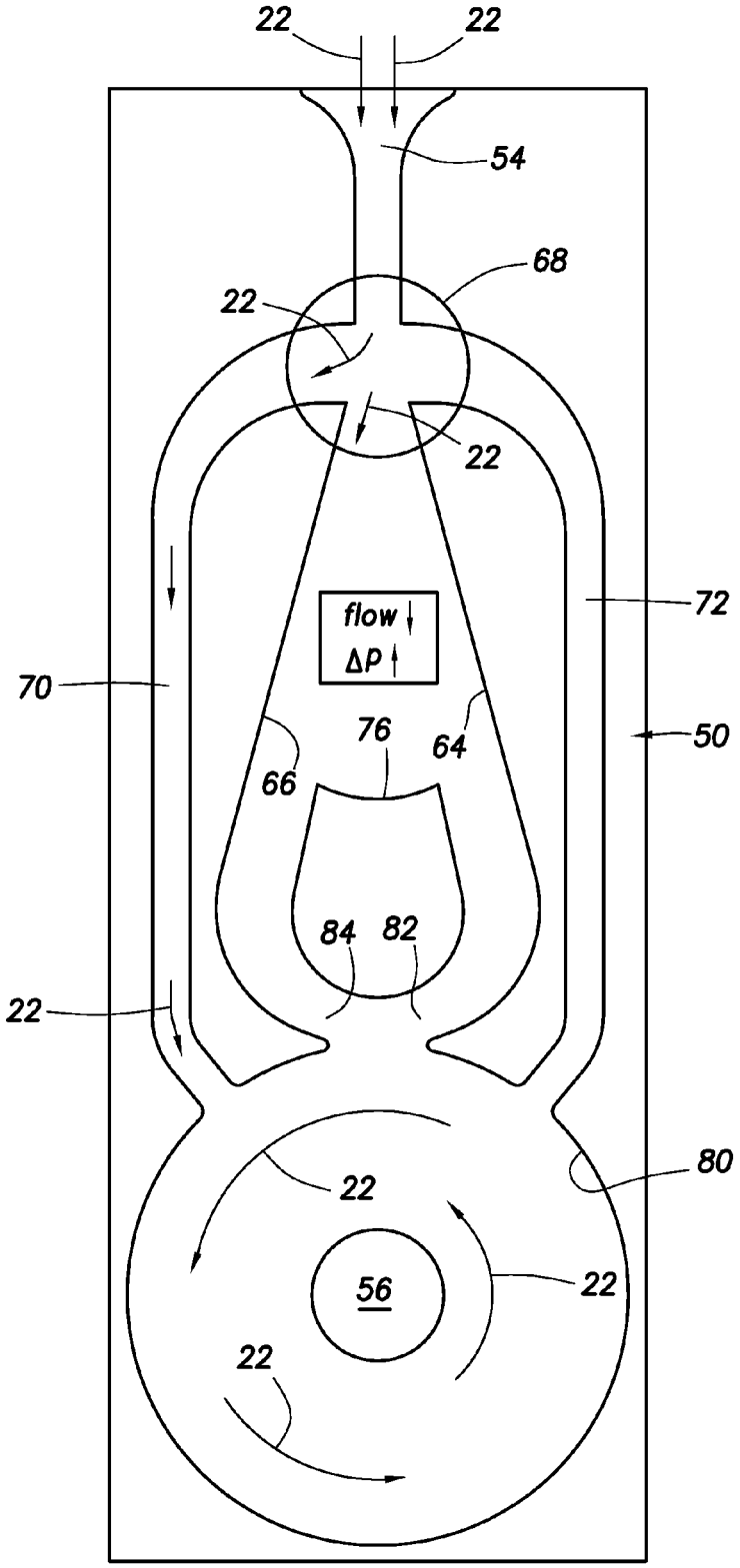

In FIG. 16, the vortex in the chamber 80 has begun to dissipate. As the vortex dissipates, the resistance to flow through the chamber 80 decreases.

Figure 17:
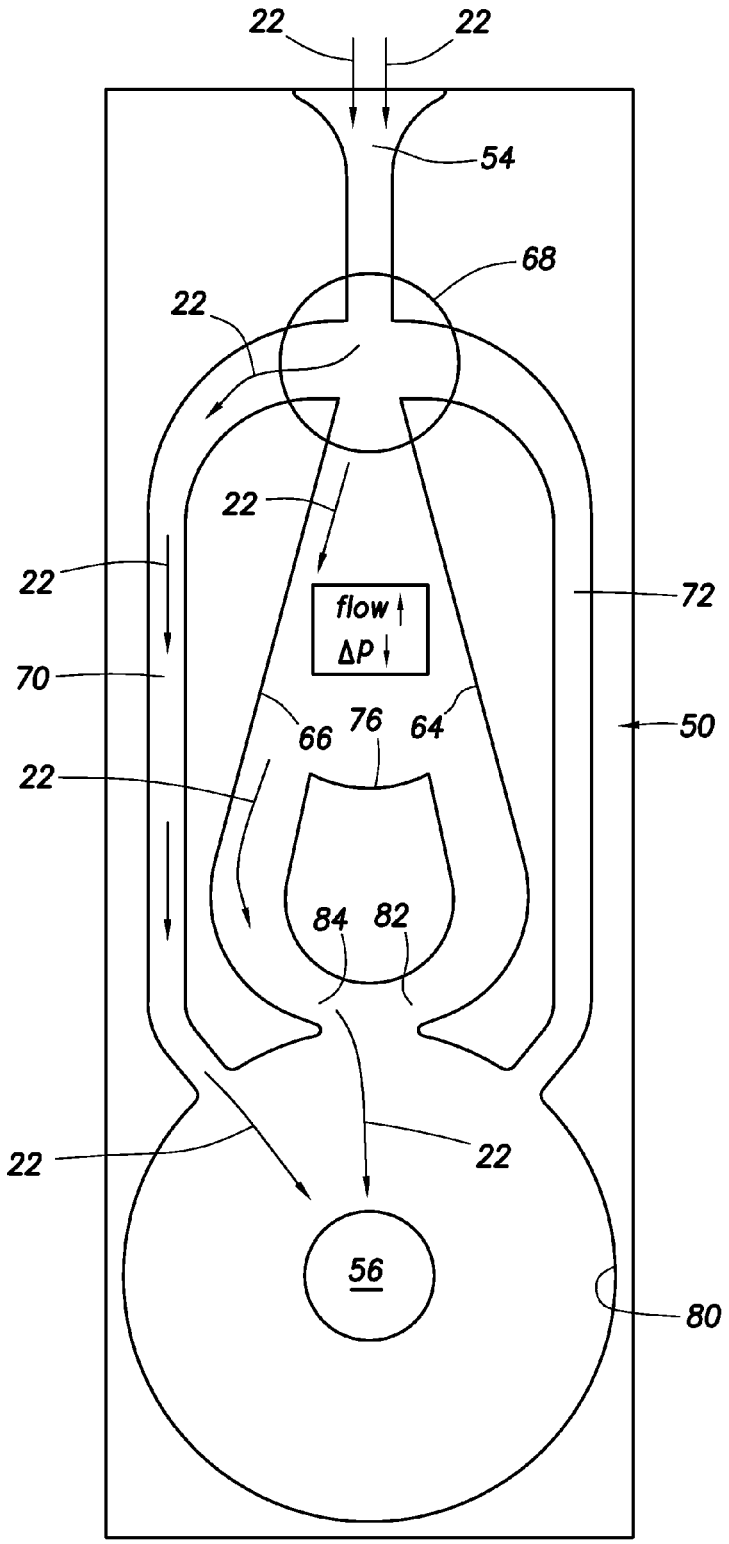

In FIG. 17, the vortex has dissipated in the chamber 80. The fluid 22 can now flow into the chamber 80 via the inlet 84 and the feedback fluid path 70.

The fluid 22 can flow substantially radially from the inlet 84 and feedback fluid path 70 to the output 56. Resistance to flow through the vortex chamber 80 is at its minimum. Pressure differential from the input 54 to the output 56 may be at its minimum. The flow rate of the fluid 22 through the fluidic oscillator 50 may be at its maximum.

Figure 18:
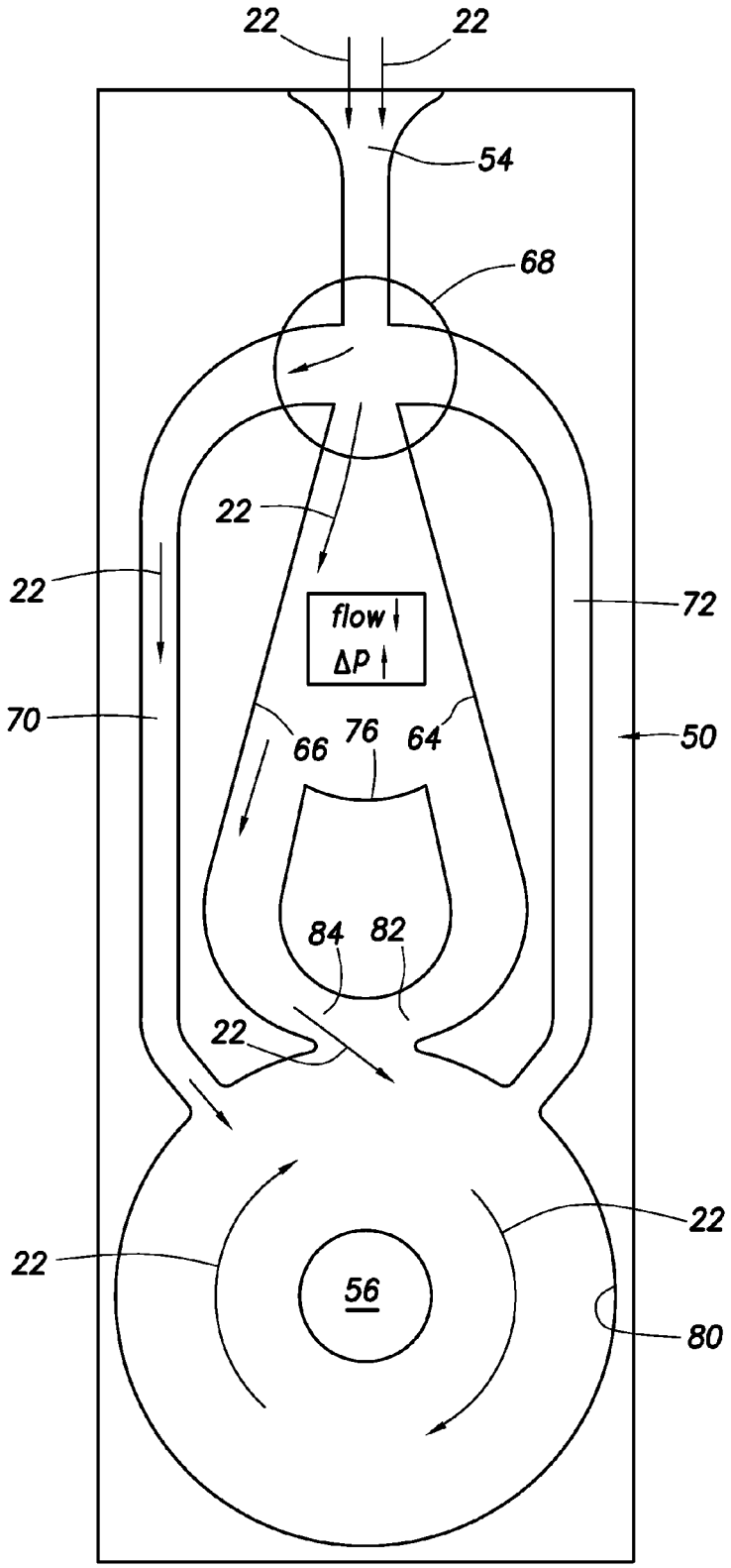

In FIG. 18, a vortex has formed in the vortex chamber 80 and resistance to flow through the vortex chamber thereby increases. As the strength of the vortex increases, the resistance to flow through the vortex chamber 80 increases, and the pressure differential from the input 54 to the output 56 increases and/or the rate of flow of the fluid 22 through the fluidic oscillator 50 decreases.

Figure 19:
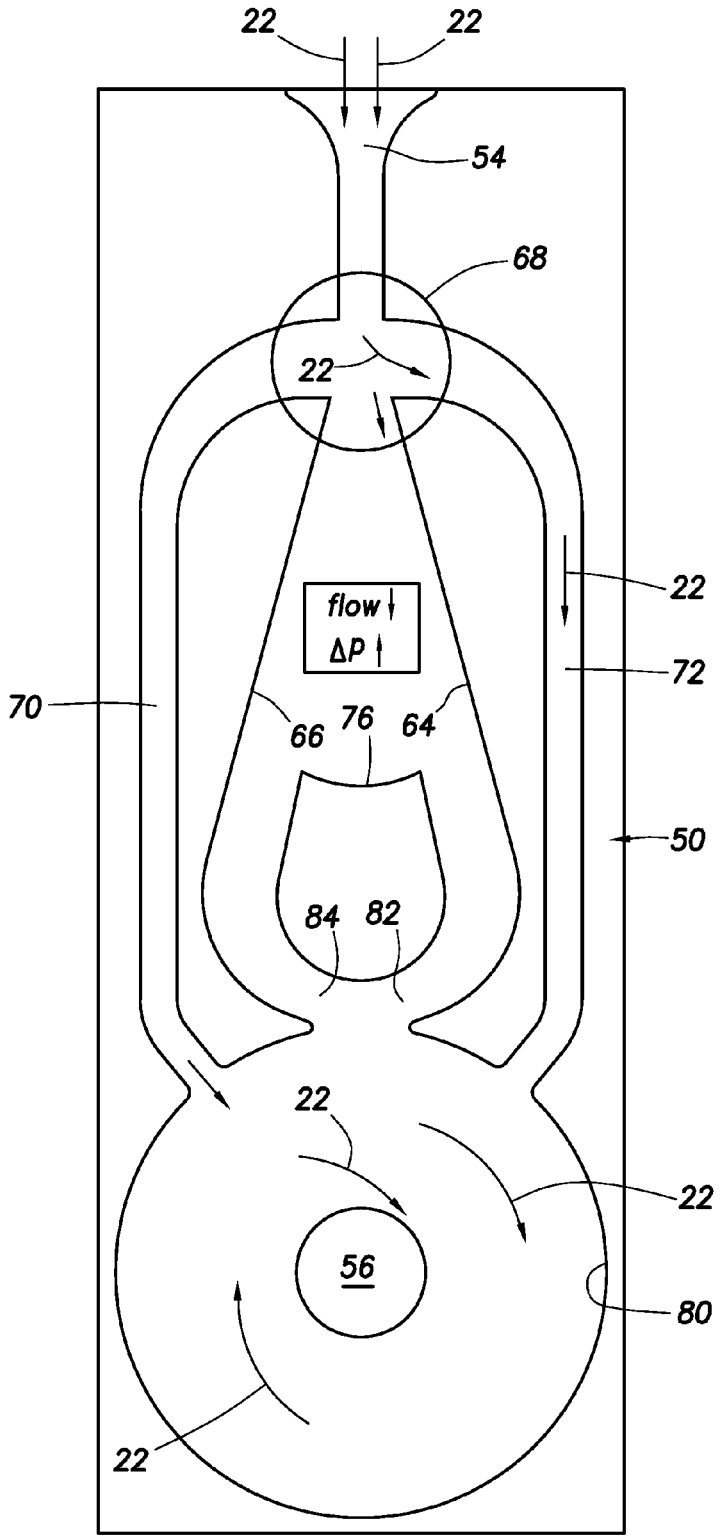

In FIG. 19, the vortex is at its maximum strength in the chamber 80. The fluid 22 flows substantially circumferentially about the chamber 80 (in a clockwise direction as viewed in FIG. 19). Resistance to flow through the vortex chamber 80 is at its maximum. Pressure differential from the input 54 to the output 56 may be at its maximum. The flow rate of the fluid 22 through the fluidic oscillator 50 may be at its minimum.

Flow through the fluidic oscillator 50 has now completed one cycle. The flow characteristics of FIG. 19 are similar to those of FIG. 13, and so it will be appreciated that the fluid 22 flow through the fluidic oscillator 50 will repeatedly cycle through the FIGS. 13-18 states.

In some circumstances (such as stimulation operations, etc.), the flow rate through the fluidic oscillator 50 may remain substantially constant while a pressure differential across the fluidic oscillator oscillates. In other circumstances (such as production operations, etc.), a substantially constant pressure differential may be maintained across the fluidic oscillator while a flow rate of the fluid 22 through the fluidic oscillator oscillates.

Figure 20:
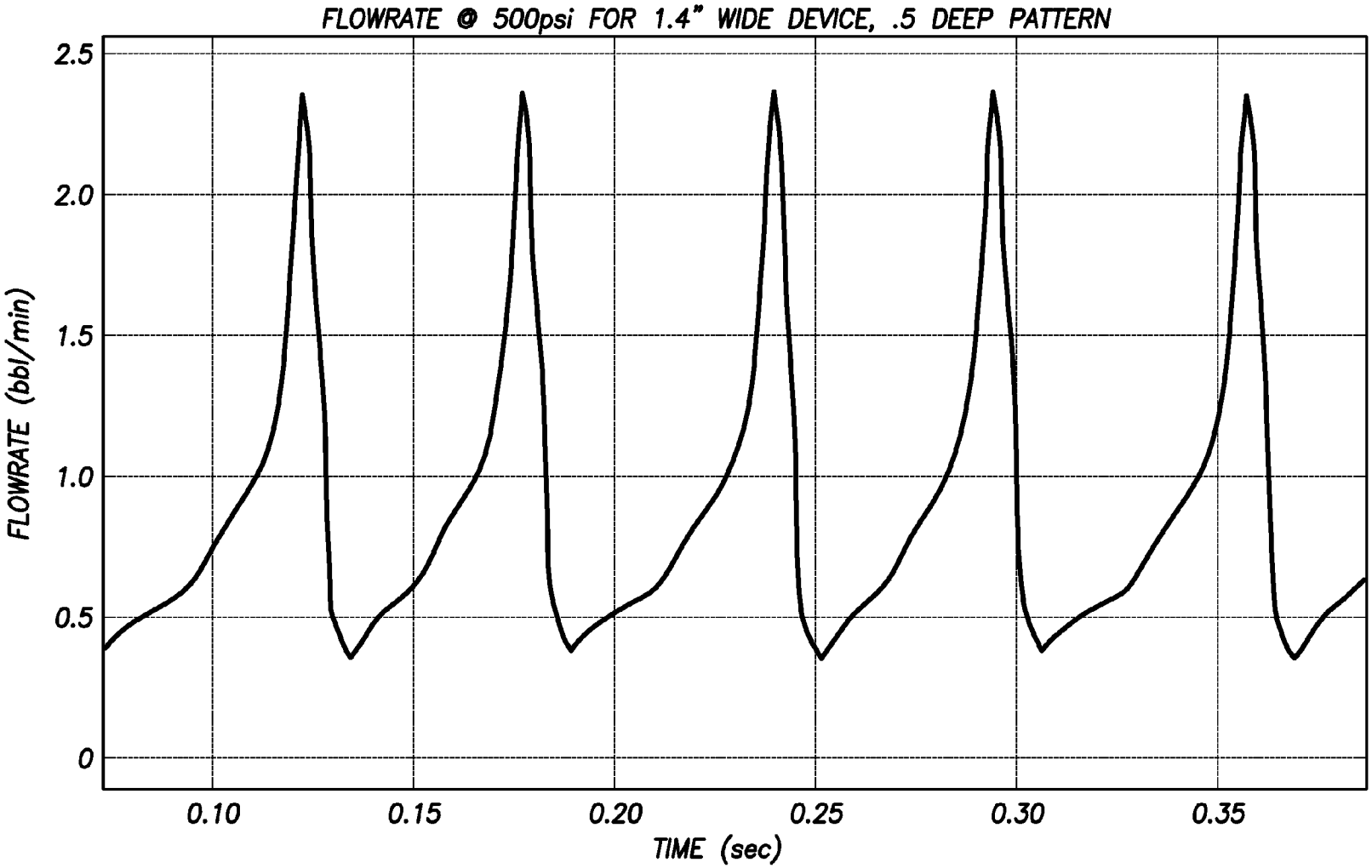
FIG. 20 is a representative graph of flow rate vs. time for an example of the fluidic oscillator.

Referring additionally now to FIG. 20, an example graph of flow rate vs. time is representatively illustrated. In this example, the pressure differential across the fluidic oscillator 50 is maintained at 500 psi, and the flow rate oscillates between about 0.4 bbl/min and about 2.4 bbl/min.

This represents about a 600% increase from minimum to maximum flow rate through the fluidic oscillator 50. Of course, other flow rate ranges may be used in keeping with the principles of this disclosure.

Experiments performed by the applicants indicate that pressure oscillations can be as high as 10:1. Furthermore, these results can be produced at frequencies as low as 17 Hz. Of course, appropriate modifications to the fluidic oscillator 50 can result in higher or lower flow rate or pressure oscillations, and higher or lower frequencies.

Figure 21:
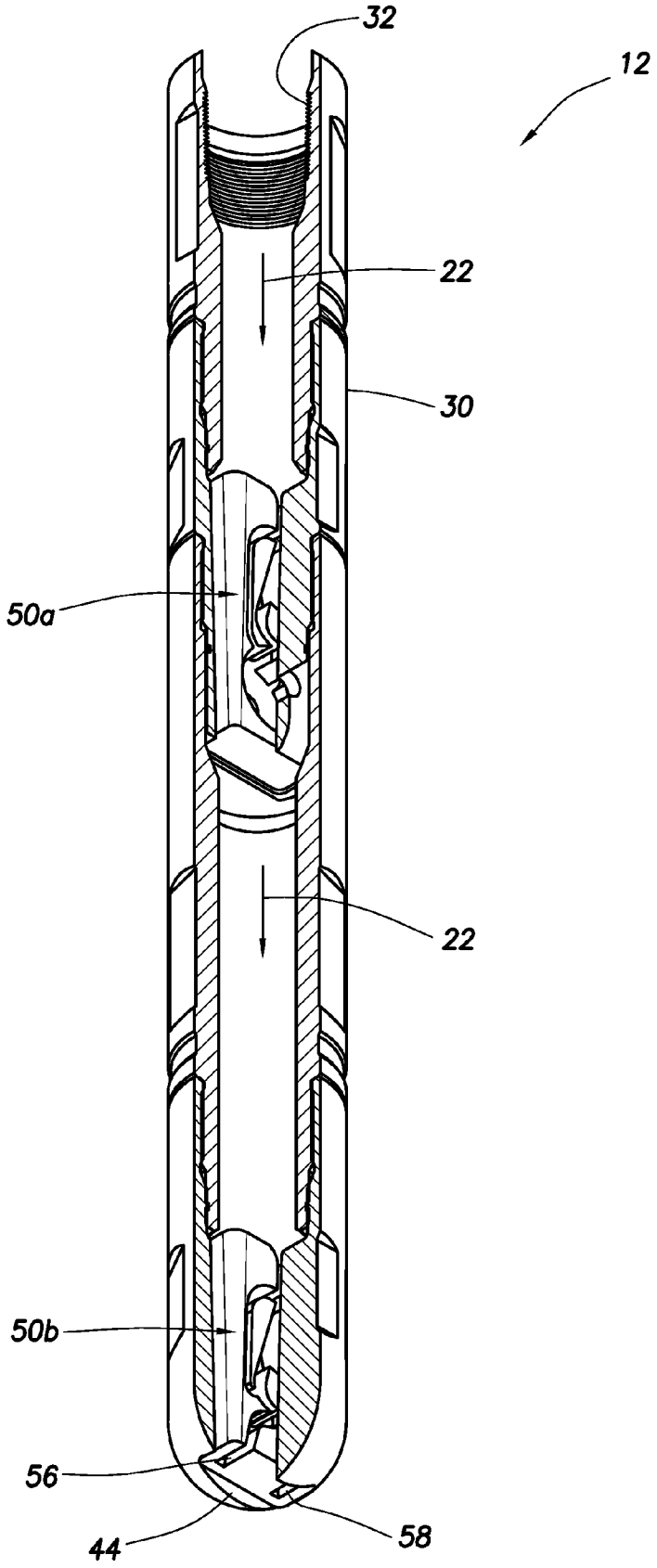
FIG. 21 is a representative partially cross-sectional isometric view of another configuration of the well tool.

Referring additionally now to FIG. 21, another configuration of the well tool 12 is representatively illustrated. In this configuration, two of the fluidic oscillators 50*a,b* are used, one upstream of the other.

The upstream fluidic oscillator 50*a* in this example is of the type illustrated in FIGS. 11-19, having a vortex chamber 80 downstream of a crossing 65 at an intersection of fluid paths 60, 62. As described above, a flow rate of the fluid 22 through the fluidic oscillator 50 of FIGS. 11-19 varies periodically (see, for example, FIG. 20), e.g., with a particular frequency determined by various factors. However, note that any oscillator which produces a varying flow rate output may be used for the fluidic oscillator 50*a*.

The downstream fluidic oscillator 50*b* in the example depicted in FIG. 21 is of the type illustrated in FIG. 6, having a crossing 65 between a fluid switch 68 and fluid outputs 56, 58. However, note that any other fluidic oscillator may be used for the fluidic oscillator 50*b* in keeping with the scope of this disclosure.

A frequency of the alternating flow between the outputs 56, 58 of the fluidic oscillator 50*b* is dependent on the flow rate of the fluid 22 through the fluidic oscillator. Thus, as the flow rate of the fluid 22 from the fluidic oscillator 50*a* to the fluidic oscillator 50*b* varies, so does the frequency of the discharge flow alternating between the outputs 56, 58.

Figure 22:
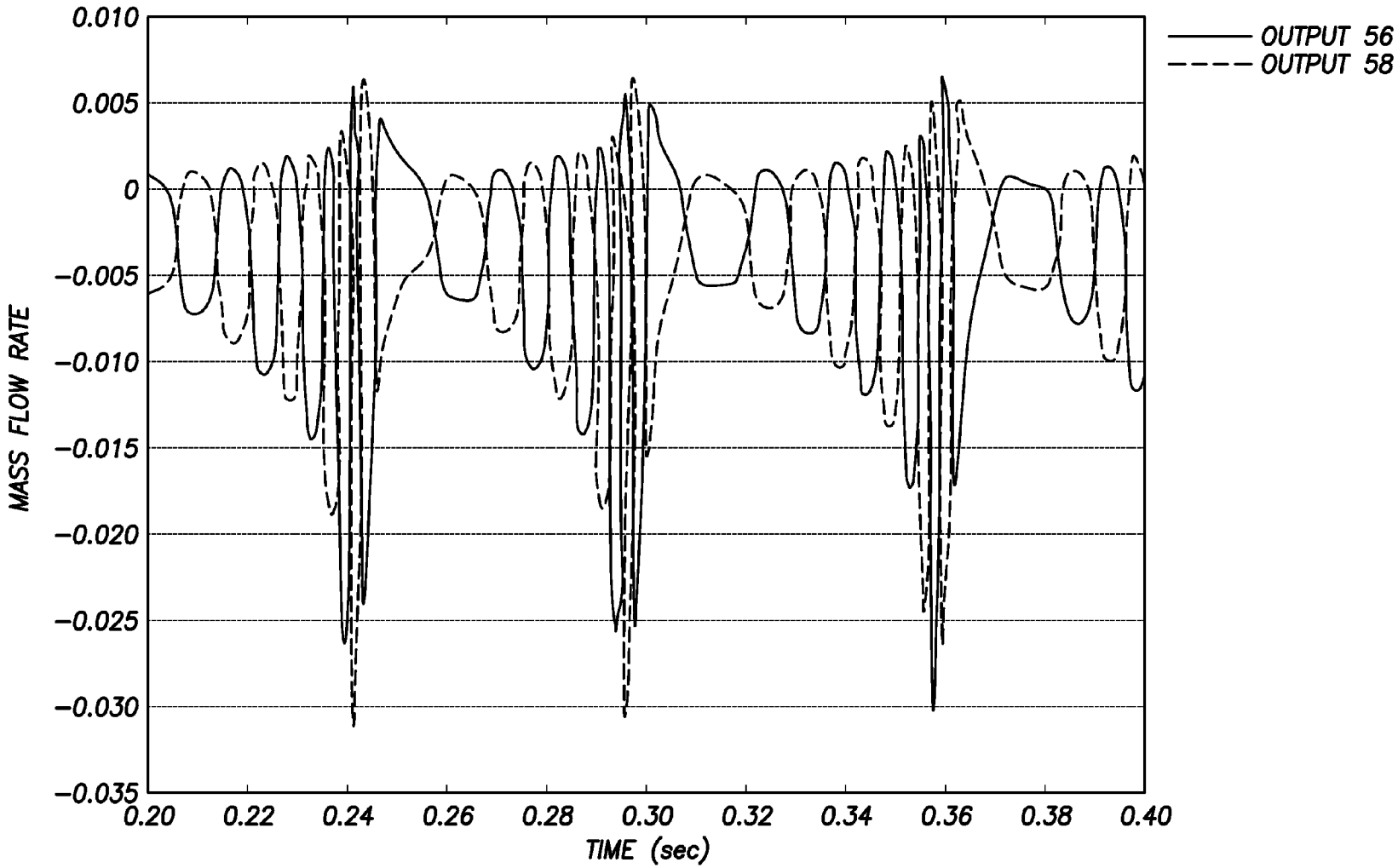
FIG. 22 is a representative graph of flow rate vs. time for the FIG. 21 well tool.

In FIG. 22, an example graph of mass flow rate versus time for flow discharged from the outputs 56, 58 is representatively illustrated (negative flow rate in this graph corresponding to discharge of the fluid 22 from the respective output 56, 58. As will be appreciated from the FIG. 22 graph, the frequency of the alternating flow from the outputs 56, 58 varies periodically, corresponding with the periodic variation in flow rate of the fluid 22 received from the fluidic oscillator 50*a*.

More specifically, the alternating flow frequency repeatedly "sweeps" a range of frequencies in the example of FIG. 22. This feature can be useful, for example, to ensure that resonant frequencies in the formation 26 and/or other portions of the well system 10 are excited (with the resonant frequencies being within the range of frequencies swept by the fluidic oscillator 50*b*).

The fluidic oscillator 50*b* does not have to be designed to flow at a particular frequency (which might be estimated from known or presumed characteristics of the formation 26 and well system 10). Instead, the fluidic oscillator 50*b* can be designed to repeatedly sweep a range of frequencies, with that range being selected to encompass predicted resonant frequencies of the formation 26 and well system 10. Another benefit is that the resonant frequencies of multiple structures can be excited by sweeping a range of frequencies, instead of targeting a single predicted or estimated frequency.

It may now be fully appreciated that the above disclosure provides several advancements to the art. The fluidic oscillators 50 described above can produce large oscillations of flow rate through, and/or pressure differential across, the fluidic oscillators. These oscillations can be produced at high flow rates and low frequencies, and the fluidic oscillators 50 are robust and preferably free of any moving parts.

The above disclosure provides to the art a well tool 12. In one example, the well tool 12 can include a first oscillator 50*a* which varies a flow rate of fluid 22 through the first oscillator 50*a*, and a second oscillator 50*b* which varies a frequency of discharge of the fluid 22 received from the first oscillator 50*a*.

The first oscillator 50*a* can include a vortex chamber 80. The vortex chamber 80 may comprise an output 56 and inlets 82, 84, whereby fluid 22 enters the vortex chamber 80 alternately via the inlets 82, 84. The inlets 82, 84 can be configured so that the fluid 22 enters the vortex chamber 80 in different directions via the respective inlets 82, 84.

The first oscillator 50*a* may comprise a fluid switch 68 which directs the fluid 22 alternately toward first and second fluid paths 60, 62 in response to pressure differentials between first and second feedback fluid paths 70, 72. The first and second feedback fluid paths 70, 72 may be connected to a vortex chamber 80.

The first and second fluid paths 60, 62 may cross each other between the fluid switch 68 and the output 56.

A method is also described above. In one example, the method can include flowing a fluid 22 through a first oscillator 50*a*, thereby repeatedly varying a flow rate of the fluid 22 discharged from the first oscillator 50*a*, and receiving the fluid 22 from the first oscillator 50*a* into a second oscillator 50*b*.

The method can also include repeatedly varying a frequency of discharge of the fluid 22 from the second oscillator 50*b* in response to the varying of the flow rate of the fluid 22 discharged from the first oscillator 50*a*.

Flowing the fluid 22 through the first oscillator 50*a* may include flowing the fluid 22 through a vortex chamber 80 of the first oscillator 50*a*. The vortex chamber 80 may comprise an output 56 and inlets 82, 84, whereby fluid 22 enters the vortex chamber 80 alternately via the inlets 82, 84. The inlets 82, 84 can be configured so that the fluid 22 enters the vortex chamber 80 in different directions via the respective inlets 82, 84.

The first oscillator 50*a* may include a fluid switch 68 which directs the fluid 22 alternately toward first and second fluid paths 60, 62 in response to pressure differentials between first and second feedback fluid paths 70, 72. The first and second feedback fluid paths 70, 72 can be connected to a vortex chamber 80.

A well tool 12 example described above can include a first oscillator 50*a* including a vortex chamber 80, and a second oscillator 50*b* which receives fluid 22 flowed through the vortex chamber 80.

The second oscillator 50*b* may comprise a fluid input 54, first and second fluid outputs 56, 58, whereby a majority of fluid 22 which flows through the second oscillator 50*b* exits the second oscillator 50*b* alternately via the first and second fluid outputs 56, 58, and first and second fluid paths 60, 62 from the fluid input 54 to the respective first and second fluid outputs 56, 58. The first and second fluid paths 60, 62 may cross each other between the fluid input 54 and the respective first and second fluid outputs 56, 58.

The first oscillator 50*a* may include multiple inlets 82, 84 to the vortex chamber 80, whereby fluid 22 enters the vortex chamber 80 alternately via the inlets 82, 84, the inlets being configured so that the fluid 22 enters the vortex chamber 80 in different directions via the respective inlets 82, 84, and a fluid switch 68 which directs the fluid 22 alternately toward different fluid paths 60, 62 in response to pressure differentials between feedback fluid paths 70, 72.

The first and second fluid paths 60, 62 may cross each other between the fluid switch 68 and an outlet 56 from the vortex chamber 80.

The first oscillator 50*a* may repeatedly vary a flow rate of the fluid 22 through the first oscillator 50*a*. The second oscillator 50*b* may discharge the fluid 22 at repeatedly varying frequencies.

The first oscillator 50*a* may vary a flow rate of the fluid 22, and the second oscillator 50*b* may vary a frequency of discharge of the fluid 22.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool, comprising:

a first oscillator through which a fluid flows, wherein the first oscillator varies a flow rate of the fluid; and a second oscillator through which the fluid flows after flowing through the first oscillator, wherein the fluid is discharged from the second oscillator at a variable frequency, wherein the first oscillator comprises a vortex chamber, wherein the vortex chamber comprises an output and first and second inlets, wherein the fluid enters the vortex chamber alternately via the first and second inlets, and wherein the fluid enters the vortex chamber in different directions via the respective first and second inlets.

2. The well tool of claim 1, wherein the first oscillator comprises a fluid switch which directs the fluid alternately toward first and second fluid paths in response to pressure differentials between first and second feedback fluid paths.

3. The well tool of claim 2, wherein the first and second feedback fluid paths are connected to the vortex chamber.

4. The well tool of claim 2, wherein the first and second fluid paths cross each other between the fluid switch and the output.

5. A method, comprising:

flowing a fluid through a first oscillator, thereby repeatedly varying a flow rate of the fluid discharged from the first oscillator; and receiving the fluid from the first oscillator into a second oscillator, wherein flowing the fluid through the first oscillator further comprises flowing the fluid through a vortex chamber of the first oscillator, wherein the vortex chamber comprises an output and first and second inlets, wherein fluid enters the vortex chamber alternately via the first and second inlets, and wherein the fluid enters the vortex chamber in different directions via the respective first and second inlets.

6. The method of claim 5, further comprising repeatedly varying a frequency of discharge of the fluid from the second oscillator in response to the varying of the flow rate of the fluid discharged from the first oscillator.

7. The method of claim 5, wherein the first oscillator comprises a fluid switch which directs the fluid alternately toward first and second fluid paths in response to pressure differentials between first and second feedback fluid paths.

8. The method of claim 7, wherein the first and second feedback fluid paths are connected to the vortex chamber.

9. The method of claim 7, wherein the first and second fluid paths cross each other between the fluid switch and the output.

10. A well tool, comprising:

a first oscillator including a vortex chamber; and a second oscillator which receives fluid flowed through the vortex chamber, wherein the second oscillator comprises:

a fluid input;

first and second fluid outputs, whereby a majority of the fluid which flows through the second oscillator exits the second oscillator alternately via the first and second fluid outputs;

first and second fluid paths from the fluid input to the respective first and second fluid outputs; and wherein the first and second fluid paths cross each other between the fluid input and the respective first and second fluid outputs.

11. The well tool of claim 10, wherein the first oscillator further comprises:

multiple inlets to the vortex chamber, wherein the fluid enters the vortex chamber alternately via the inlets, and wherein the fluid enters the vortex chamber in different directions via the respective inlets; and a fluid switch which directs the fluid alternately toward first and second fluid paths in response to pressure differentials between feedback fluid paths.

12. The well tool of claim 11, wherein the first and second fluid paths cross each other between the fluid switch and an outlet from the vortex chamber.

13. The well tool of claim 10, wherein the first oscillator repeatedly varies a flow rate of the fluid through the first oscillator.

14. The well tool of claim 13, wherein the second oscillator discharges the fluid at repeatedly varying frequencies.

15. The well tool of claim 10, wherein the first oscillator varies a flow rate of the fluid, and wherein the second oscillator varies a frequency of discharge of the fluid.

* * * * *